US011458355B2

(12) United States Patent
Lagree et al.

(10) Patent No.: US 11,458,355 B2
(45) Date of Patent: Oct. 4, 2022

(54) EXERCISE MACHINE

(71) Applicant: Lagree Technologies, Inc., Chatsworth, CA (US)

(72) Inventors: Sebastien Anthony Louis Lagree, Chatsworth, CA (US); Todd G. Remund, Yuba City, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 182 days.

(21) Appl. No.: 17/002,463

(22) Filed: Aug. 25, 2020

(65) Prior Publication Data

US 2022/0062697 A1 Mar. 3, 2022

(51) Int. Cl.

*A63B 22/00* (2006.01)
*A63B 21/04* (2006.01)
*A63B 21/00* (2006.01)

(52) U.S. Cl.

CPC ..... *A63B 22/0089* (2013.01); *A63B 21/0428* (2013.01); *A63B 21/4035* (2015.10)

(58) Field of Classification Search

CPC ..... A63B 21/0428; A63B 2225/09; A63B 2225/102; A63B 21/0442; A63B 2210/50; A63B 21/0552; A63B 21/068; A63B 23/03566; A63B 21/4045; A63B 22/203; A63B 69/0057; A63B 21/00058–00065; A63B 21/02–025; A63B 21/04; A63B 21/0407; A63B 21/05; A63B 21/055–0557; A63B 21/4033–4035; A63B 22/0076–2022/0084; A63B 22/0087–0089

See application file for complete search history.

(56) References Cited

U.S. PATENT DOCUMENTS 1,621,477 A 8/1925 Pilates
3,770,267 A 11/1973 McCarthy
(Continued)

FOREIGN PATENT DOCUMENTS

WO 2004/096376 A1 11/2004

OTHER PUBLICATIONS

Notice of Allowance Document for U.S. Appl. No. 14/144,771; Received from USPTO dated Apr. 15, 2022.

*Primary Examiner* — Joshua Lee
*Assistant Examiner* — Catrina A Letterman
(74) *Attorney, Agent, or Firm* — Neustel Law Offices

(57) ABSTRACT

An exercise machine which includes a centralized spring box and multiple gripping surfaces with which an exerciser may perform a wide range of exercise moves. The exercise machine includes a movable carriage and platform on a track. Bias members may be connected between the carriage and various structural elements of the exercise machine so as to impart a resistance force against movement of the carriage. An outer handle may be positioned around a carriage platform so as to surround the carriage platform. Inner handles may be positioned between the carriage platform and the outer handle, with the inner handle(s) being connected not to the outer handle or the carriage platform, but to an underlying support assembly. A pair of end handles may extend outwardly from the ends of the exercise machine. A bias member retainer such as a spring box may be centrally-located along the length of the exercise machine.

17 Claims, 22 Drawing Sheets

(56) References Cited

U.S. PATENT DOCUMENTS 4,759,540 A 7/1988 Yu
4,798,378 A 1/1989 Jones
5,066,005 A 11/1991 Luecke
5,263,913 A 11/1993 Boren
D362,700 S 9/1995 Breibart
D382,319 S 8/1997 Gerschefske
5,681,249 A 10/1997 Endelman
5,885,197 A 3/1999 Barton
5,967,955 A 10/1999 Westfall
6,179,753 B1 1/2001 Barker
7,163,500 B2 1/2007 Endelman
7,803,095 B1 9/2010 Lagree
7,931,570 B2 4/2011 Hoffman
9,597,545 B1 3/2017 Lagree
10,843,031 B1 * 11/2020 Anne ..... A63B 22/0087
2001/0056011 A1 12/2001 Endelman
2003/0119635 A1 6/2003 Arbuckle
2005/0164856 A1 7/2005 Parmater
2006/0046914 A1 3/2006 Endelman
2006/0199712 A1 9/2006 Barnard
2008/0070765 A1 3/2008 Brown
2008/0248935 A1 10/2008 Solow
2010/0227748 A1 9/2010 Campanaro
2011/0143898 A1 6/2011 Trees
2011/0166002 A1 7/2011 Savsek
2011/0172069 A1 7/2011 Gerschefske
2012/0295771 A1 * 11/2012 LaGree ..... A63B 22/203
482/94
2014/0011645 A1 1/2014 Johnson
2014/0100089 A1 4/2014 Kermath
2014/0121076 A1 * 5/2014 Lagree ..... A63B 21/0442
482/123
2014/0121078 A1 5/2014 Lagree
2014/0121079 A1 5/2014 Lagree
2014/0141948 A1 5/2014 Aronson
2015/0024914 A1 * 1/2015 Lagree ..... A63B 21/4045
482/142
2015/0057127 A1 2/2015 Lagree
2015/0065318 A1 3/2015 Lagree
2015/0072841 A1 3/2015 Lagree
2015/0141204 A1 5/2015 Lagree
2015/0217164 A1 8/2015 Lagree
2015/0220523 A1 8/2015 Lagree
2015/0246263 A1 9/2015 Campanaro
2015/0297944 A1 10/2015 Lagree
2015/0343250 A1 12/2015 Lagree
2015/0360068 A1 12/2015 Lagree
2015/0360083 A1 12/2015 Lagree
2015/0360113 A1 12/2015 Lagree
2015/0364058 A1 12/2015 Lagree
2015/0367166 A1 12/2015 Lagree
2016/0008657 A1 1/2016 Lagree
2016/0059060 A1 3/2016 Lagree
2016/0059061 A1 3/2016 Lagree
2016/0096059 A1 4/2016 Lagree
2016/0166870 A1 6/2016 Lagree
2016/0193496 A1 7/2016 Lagree
2016/0256733 A1 9/2016 Lagree
2016/0271452 A1 9/2016 Lagree
2016/0317858 A1 11/2016 Lagree
2016/0346593 A1 12/2016 Lagree
2016/0361602 A1 12/2016 Lagree
2017/0014664 A1 1/2017 Lagree
2017/0014672 A1 1/2017 Lagree
2017/0036057 A1 2/2017 Lagree
2017/0036061 A1 2/2017 Lagree
2017/0065846 A1 3/2017 Lagree
2017/0072252 A1 3/2017 Lagree
2017/0087397 A1 3/2017 Lagree
2017/0100625 A1 4/2017 Lagree
2017/0100629 A1 4/2017 Lagree
2017/0106232 A1 4/2017 Lagree
2017/0113091 A1 4/2017 Lagree
2017/0120101 A1 5/2017 Lagree
2017/0144013 A1 5/2017 Lagree
2017/0157452 A1 6/2017 Lagree
2017/0157458 A1 6/2017 Lagree
2017/0165518 A1 6/2017 Lagree
2017/0165555 A1 6/2017 Lagree
2017/0189740 A1 7/2017 Lagree
2017/0189741 A1 7/2017 Lagree
2017/0209728 A1 * 7/2017 Lagree ..... A63B 22/0089
2017/0239526 A1 8/2017 Lagree
2017/0246491 A1 8/2017 Lagree
2017/0246499 A1 8/2017 Lagree
2017/0296865 A1 10/2017 Lagree
2017/0304673 A1 10/2017 Lagree
2017/0326406 A1 11/2017 Lagree
2017/0340947 A1 11/2017 Lagree
2017/0354840 A1 12/2017 Lagree
2018/0015319 A1 1/2018 Lagree
2018/0021621 A1 1/2018 Lagree
2018/0021655 A1 1/2018 Lagree
2018/0036583 A1 2/2018 Lagree
2018/0056109 A1 3/2018 Lagree
2018/0056133 A1 3/2018 Lagree
2018/0111020 A1 4/2018 Lagree
2018/0111033 A1 4/2018 Lagree
2018/0117392 A1 5/2018 Lagree
2018/0133532 A1 5/2018 Lagree
2018/0133533 A1 5/2018 Lagree
2018/0133534 A1 5/2018 Lagree
2018/0133542 A1 5/2018 Lagree
2018/0178053 A1 * 6/2018 Lagree ..... A63B 21/4027
2018/0193691 A1 7/2018 Lagree
2018/0250551 A1 9/2018 Lagree
2018/0250573 A1 9/2018 Lagree
2018/0272179 A1 9/2018 Lagree
2018/0280782 A1 10/2018 Lagree
2018/0318627 A1 11/2018 Lagree
2018/0318646 A1 11/2018 Lagree
2018/0326252 A1 11/2018 Lagree
2018/0353803 A1 12/2018 Lagree
2018/0361190 A1 12/2018 Lagree
2018/0361197 A1 12/2018 Lagree
2019/0083842 A1 3/2019 Lagree
2019/0160320 A1 5/2019 Lagree
2019/0160329 A1 * 5/2019 Lagree ..... A63B 71/06
2019/0232105 A1 8/2019 Lagree
2019/0240530 A1 8/2019 Lagree
2019/0247694 A1 8/2019 Lagree
2019/0247705 A1 8/2019 Lagree
2019/0247707 A1 8/2019 Lagree
2019/0255375 A1 8/2019 Lagree
2019/0269961 A1 9/2019 Lagree
2019/0314672 A1 10/2019 Lagree
2019/0358484 A1 11/2019 Lagree
2020/0030657 A1 1/2020 Lagree
2020/0047051 A1 2/2020 Lagree
2020/0054913 A1 2/2020 Lagree
2020/0078630 A1 3/2020 Lagree
2020/0078634 A1 3/2020 Lagree
2020/0171337 A1 6/2020 Lagree
2020/0188737 A1 * 6/2020 Villency ..... A63B 22/0002
2020/0222741 A1 * 7/2020 Aronson ..... A63B 21/154
2020/0376326 A1 12/2020 Lagree
2021/0220694 A1 7/2021 Lagree

* cited by examiner

EXERCISE MACHINE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to an exercise machine which includes a centralized spring box and multiple gripping surfaces with which an exerciser may perform a wide range of exercise moves.

Related Art

Any discussion of the related art throughout the specification should in no way be considered as an admission that such related art is widely known or forms part of common general knowledge in the field.

Exercise machines have become ubiquitous in modern life. A wide range of exercise machines are available for use in both home gyms and in studio gyms catering to multiple exercisers at once. A common exercise machine may include a movable carriage that reciprocates along a track, with one or more bias members being connected to the movable carriage so as to impart a resistance force against movement of the movable carriage in a certain direction.

Such exercise machines may include a number of handles for gripping by the exerciser. However, in the past, the available gripping surfaces on the exercise machine have been limited, thus limiting the availability of exercise moves to be performed on such exercise machines. Such exercise machines typically do not have handles which extend outwardly from the outer ends of the exercise machines so that an exerciser may perform various exercise moves while positioned adjacent to the respective ends of the exercise machine. Further, such exercise machines may not include bias member retainers such as spring boxes which protect the exerciser from the bias members.

SUMMARY

An example embodiment is directed to an exercise machine. The exercise machine includes a carriage which is movably positioned on a track. One or more bias members may be selectively connected between the carriage and various structural elements of the exercise machine so as to impart a resistance force against movement of the carriage along the track. An outer handle may be connected to the carriage so as to surround the carriage platform. One or more inner handles may be positioned between the carriage platform and the outer handle, with the inner handle(s) being connected not to the outer handle or the carriage platform, but to an underlying support assembly. A pair of end handles may extend outwardly from the ends of the exercise machine. A bias member retainer such as a spring box may be centrally-located along the length of the exercise machine.

There has thus been outlined, rather broadly, some of the embodiments of the exercise machine in order that the detailed description thereof may be better understood, and in order that the present contribution to the art may be better appreciated. There are additional embodiments of the exercise machine that will be described hereinafter and that will form the subject matter of the claims appended hereto. In this respect, before explaining at least one embodiment of the exercise machine in detail, it is to be understood that the exercise machine is not limited in its application to the details of construction or to the arrangements of the components set forth in the following description or illustrated in the drawings. The exercise machine is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1A:
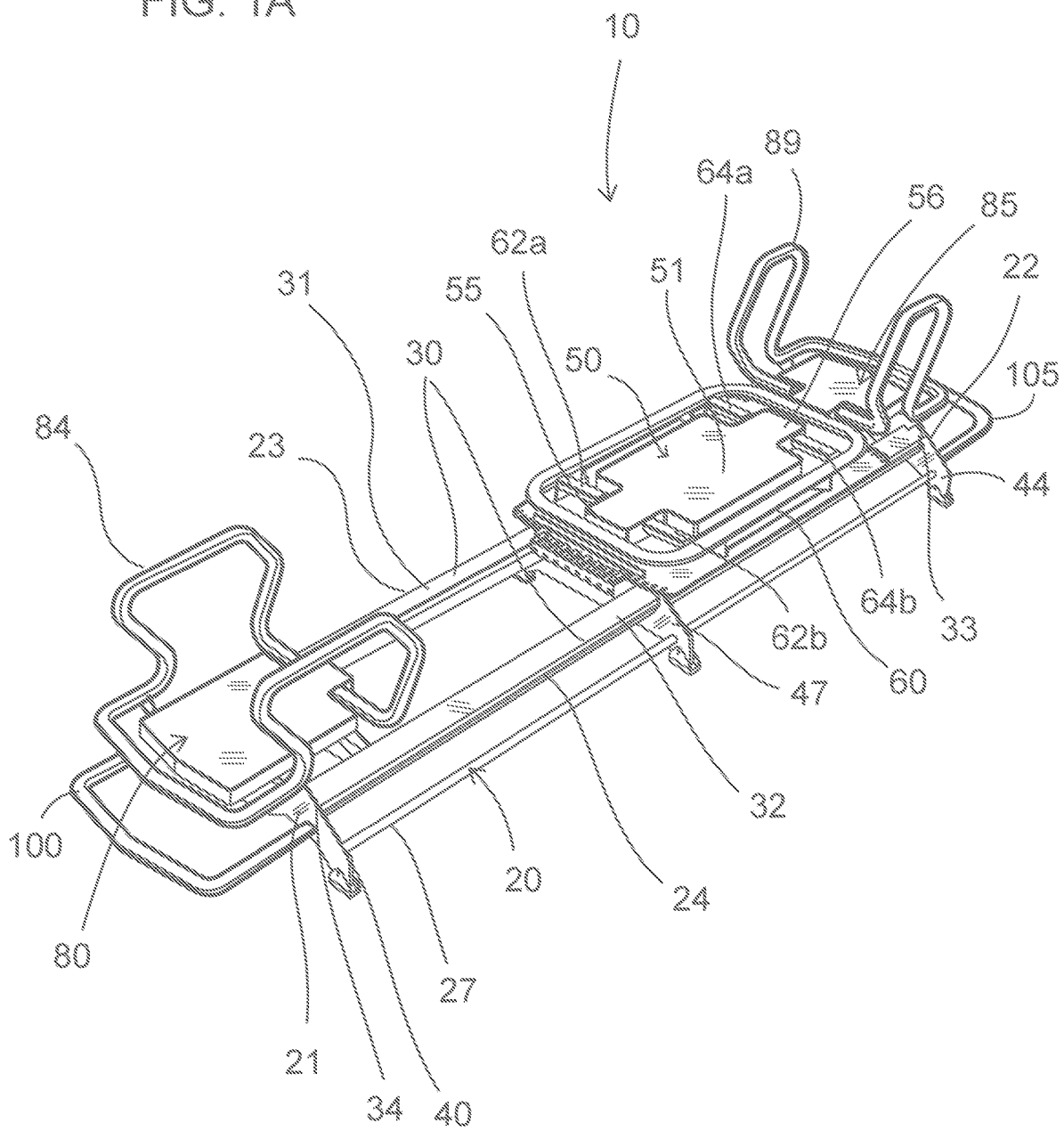
FIG. 1A is a perspective view of an exercise machine in accordance with an example embodiment.

A. Overview.

An example exercise machine 10 generally comprises a frame 20 having a first end 21, a second end 22 opposite of the first end 21, and a longitudinal axis extending therebetween, wherein the frame 20 comprises a track 30 including at least one rail 31, 32; a carriage 50 movably positioned upon the track 30, wherein the carriage 50 comprises a support frame 71 and a carriage platform 51 connected to the support frame 71, the carriage platform 51 having a first end 55, a second end 56 opposite the first end 55 of the carriage platform 51, a first side 57, a second side 58 opposite the first side 57 of the carriage platform 51, an upper end, and a lower end opposite the upper end of the carriage platform 51, wherein the first end 51 and the second end 52 of the carriage platform 51 are spaced apart along the longitudinal axis; wherein the carriage 50 is adapted to be movable in opposed first and second directions along at least a portion of the track 30; a bias member 92 connected between the carriage 50 and the frame 20, wherein the bias member 92 is adapted to provide a resistance force against movement of the carriage 50 on the track 30; an outer handle 60 connected to the support frame 71, wherein the outer handle 60 comprises a first end 140, a second side 141, a first side 142, and a second side 143, wherein the outer handle 60 extends around the carriage platform 51 such that the outer handle 60 surrounds the carriage platform 51, wherein the outer handle 60 is not directly connected to the carriage platform 51.

The outer handle 60 is not in contact with the carriage platform 51. The support frame 71 comprises a first front support 72 including a first front bracket 130, wherein the outer handle 60 is connected to the first front bracket 130 of the first front support 72 at or near the first end 140 of the outer handle 60. The first front bracket 130 comprises a first front cutout 131, wherein the outer handle 60 is connected within the first front cutout 131 of the first front bracket 130. The support frame 71 comprises a first rear support 74 including a first rear bracket 134, wherein the outer handle 60 is connected to the first rear bracket 134 of the first rear support 74.

The exercise machine 10 may comprise a first inner handle 62*a* positioned between the first side 57 of the carriage platform 51 and the outer handle 60, wherein the first inner handle 62*a* is connected to the support frame 71, wherein the first inner handle 62*a* is not connected to the outer handle 60 or the carriage platform 51; and a second inner handle 62*b* positioned between the second side 58 of the carriage platform 51 and the outer handle 60, wherein the second inner handle 62*b* is connected to the support frame 71, wherein the second inner handle 62*b* is not connected to the outer handle 60 or the carriage platform 51.

In an exemplary embodiment, the carriage platform 51 comprises a central portion 52, a first end portion 53 extending from a first end of the central portion 52, and a second end portion 54 extending from a second end of the central portion 52, wherein the central portion 52 of the carriage platform 51 is wider than the first end portion 53 and the second end portion 54 of the carriage 50. The first inner handle 62*a* and the second inner handle 62*b* are each positioned between the first end portion 53 of the carriage platform 51 and the outer handle 60.

In an exemplary embodiment, a third inner handle 64*a* is positioned between the first side 57 of the carriage platform 51 and the outer handle 60, wherein the third inner handle 64*a* is connected to the support frame 71, wherein the third inner handle 64*a* is not connected to the outer handle 60 or the carriage 50. The third inner handle 64*a* is positioned between the second end portion 54 of the carriage platform 51 and the outer handle 60.

In an exemplary embodiment, a fourth inner handle 64*b* is positioned between the second side 58 of the carriage platform 51 and the outer handle 60, wherein the fourth inner handle 64*b* is connected to the support frame 71, wherein the fourth inner handle 64*b* is not connected to the outer handle 60 or the carriage platform 51. The fourth inner handle 64*b* is positioned between the second end portion 54 of the carriage platform 51 and the outer handle 60.

The support frame 71 comprises a first front support 72 connected to the outer handle 60 and a first cross support 76. The first inner handle 62*a* is connected at a first end to the first front support 72 and at a second end to the first cross support 76.

The support frame 71 may further comprise a second front support 73 connected to the outer handle 60 and a second cross support 77. The second inner handle 62*b* may be connected at a first end to the second front support 73 and at a second end to the second cross support 77. An end platform 80, 85 may be connected at or near the first end 21 or the second end 22 of the frame 20.

Another exemplary embodiment of the exercise machine 10 may comprise a frame 20 having a first end 21, a second end 22 opposite of the first end 21, and a longitudinal axis extending therebetween, wherein the frame 20 comprises a track 30 including at least one rail 31, 32; a carriage 50 movably positioned upon the track 30, wherein the carriage 50 is adapted to be movable in opposed first and second directions along at least a portion of the track 30; a bias member 92 connected between the carriage 50 and the frame 20, wherein the bias member 92 is adapted to provide a resistance force against movement of the carriage 50 on the track 30; a first end platform 80 connected at or near the first end 21 of the frame 20; a first end handle 100 connected to the first end 21 of the frame 20 such that the first end handle 100 extends outwardly from the first end 21 of the frame 20, wherein the first end handle 100 is positioned underneath the first end platform 80.

The first end platform 80 comprises a first end platform handle 84, wherein the first end handle 100 is positioned underneath the first end platform handle 84, wherein the first end handle 100 extends parallel to the longitudinal axis. The first end handle 100 comprises a first arm 101, a second arm 102, and a cross member 103, wherein the first arm 101 and the second arm 102 are each connected to the first end 21 of the frame 20.

A second end handle 105 is connected to the second end 22 of the frame 20 such that the second end handle 105 extends outwardly from the second end 22 of the frame 20. A second end platform 85 is connected at or near the second end 22 of the frame 20, wherein the second end handle 105 is positioned underneath the second end platform 85. The second end platform 85 comprises a second end platform handle 89, wherein the second end handle 105 is positioned underneath the second end platform handle 89.

Another exemplary embodiment of the exercise machine 10 comprises a frame 20 having a first end 21, a second end 22 opposite of the first end 21, and a longitudinal axis extending therebetween, wherein the frame 20 comprises a track 30 including at least one rail 31, 32; a carriage 50 movably positioned upon the track 30, wherein the carriage 50 is adapted to be movable in opposed first and second directions along at least a portion of the track 30, wherein the carriage 50 comprises a carriage bias receiver 94; a bias member retainer 90 connected to the frame 20 underneath the carriage 50, wherein the bias member retainer 90 is positioned at a midpoint between the first end 21 and the second end 22 of the frame 20; and a bias member 92 comprising a first end and a second end, wherein the first end of the bias member 92 is connected to the bias member retainer 90, wherein the second end of the bias member 92 is selectively and removably connected to the bias member retainer 90 or the carriage bias receiver 94.

B. Exercise Machine.

As shown throughout the figures, an exemplary exercise machine 10 may comprise a track 30 and a carriage 50 movably connected to the track 30. The exercise machine 10 may comprise a frame 20 including a first end 21, a second end 22, a first side 23, and a second side 24. The shape, size, and structure of the frame 20 may vary in different embodiments, and thus should not be construed as limited by the exemplary figures. The frame 20 may comprise various structural members of the exercise machine 10. Generally, the frame 20 will be comprised of fixed elements (i.e., non-movable), though in some embodiments, some portions of the frame 20 may be movable.

As best shown in FIGS. 1, 2A, 2B, and 4, the exercise machine 10 may comprise a track 30 which extends at least partially between the first end 21 and the second end 22 of the frame 20. In some embodiments, the track 30 may not extend for the full length of the frame 20, but instead may only extend for part of the length of the frame 20. In other embodiments, the track 30 may extend from the first end 21 to the second end 22 of the frame 20. In some embodiments, the track 30 may extend past the first end 21 and/or the second end 22 of the frame 20.

The track 30 may comprise various configurations. In the exemplary embodiments shown in the figures, the track 30 is illustrated as comprising a pair of rails 31, 32. More specifically, a first rail 31 may extend along the first side 23 of the frame 20 and a second rail 32 may extend along a second side 24 of the frame 20. Each of the rails 31, 32 may extend for the full length of the frame 20 between its first end 21 and its second end 22. In some embodiments, the rails 31, 32 may extend for only part of the length of the frame 20. In other embodiments, one or both of the rails 31, 32 may extend past the length of the frame 20. The rails 31, 32 may be extend past the sides of the frame 20 (external to the width of the frame 20), or may be internal to the width of the frame 20.

As shown in the figures, the rails 31, 32 may be parallel to each other and to the longitudinal axis extending between the first and second ends 21, 22 of the frame 20. In some embodiments, more or less rails 31, 32 may be utilized. By way of example and without limitation, the track 30 could comprise a monorail configuration in which only a single rail 31, 32 is utilized. In other embodiments, three or more rails 31, 32 may be utilized.

As shown in FIGS. 1, 3, 5, and 6, the exercise machine 10 may comprise a base 27 with which it rests on an underlying surface such as a ground surface, a mat, or the like. The base 27 may be integral with the frame 20 (i.e., the base 27 may comprise a portion of the frame 20) or, in alternate embodiments, the base 27 may comprise a separate structure or structures which is/are connected to the frame 20.

The base 27 may comprise various structural elements of the exercise machine 10, such as supports 40, 44, 47 which support the exercise machine 10 on the underlying surface. In the exemplary embodiments shown in the figures, the exercise machine 10 is illustrated as comprising a first outer support 40, a second outer support 44, and a central support 47 between the outer supports 40, 44.

The first outer support 40 is illustrated as being positioned at the first end 21 of the frame 20. The first outer support 40 may be integral with the frame 20 or may be connected to the frame 20. As shown in the figures, the first outer support 40 may comprise a pair of diagonal legs which are interconnected by a substantially horizontal member. The distal end of each of the pair of diagonal legs may include a pair of first footings 41*a*, 41*b* which rest upon the underlying surface.

The second outer support 44 is illustrated as being positioned at the second end 22 of the frame 20. The second outer support 44 may be integral with the frame 20 or may be connected to the frame 20. As shown in the figures, the second outer support 44 may comprise a pair of diagonal legs which are interconnected by a substantially horizontal member. The distal end of each of the pair of diagonal legs may include a pair of second footings 45*a*, 45*b* which rest upon the underlying surface.

The central support 47 is illustrated as being positioned at the approximate midpoint between the first and second ends 21, 22 of the frame 20. The central support 47 will generally be positioned between the first outer support 40 and the second outer support 44 as shown in the figures. The positioning of the central support 47 may vary and, in some embodiments, it may be closer to the first end 21 or closer to the second end 22 of the frame 20. In some embodiments, such as an exercise machine 10 with a less lengthy frame 20, the central support 47 may be omitted. As shown in the figures, the central support 47 may comprise a pair of diagonal legs which are interconnected by a substantially horizontal member. The distal ends of each of the pair of diagonal legs may include a pair of third footings 48*a*, 48*b* which rest upon the underlying surface.

Figure 1B:
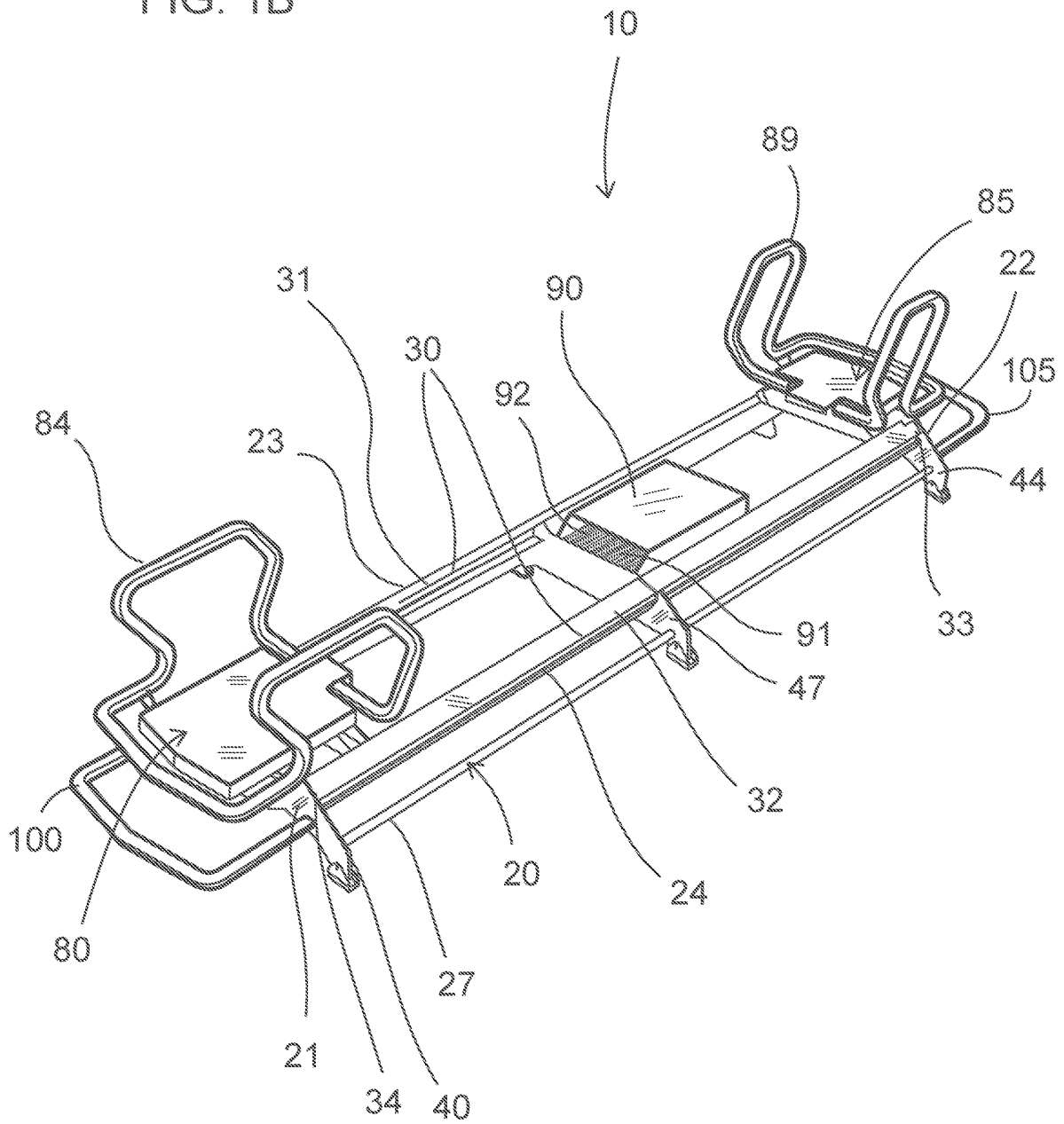
FIG. 1B is a perspective view of an exercise machine with its carriage removed in accordance with an example embodiment.

As shown in FIGS. 1, 2A, 2B, 3, and 4, the exercise machine 10 may include one or more end platforms 80, 85. With reference to FIG. 1, it can be seen that an exemplary exercise machine 10 includes a first end platform 80 at or near the first end 21 of the frame 20 and a second end platform 85 at or near the second end 22 of the frame 20. It should be appreciated that, in some embodiments, only a single end platform 80, 85 may be utilized. In other embodiments, both end platforms 80, 85 may be omitted entirely.

The shape, orientation, size, and positioning of the end platforms 80, 85 may vary in different embodiments. Further, the manner in which the end platforms 80, 85 are connected to the exercise machine 10 may vary. In the exemplary embodiment shown in the figures, the end platforms 80, 85 are illustrated as being connected both to the frame 20 and to the track 30. In some embodiments, the end platforms 80, 85 may be connected to the frame 20, the track 30, or to any other structural element of the exercise machine 10.

The exemplary figures illustrate that the first end platform 80 may comprise a first platform pad 81 on which an exerciser may rest various parts of his/her body when performing a wide range of exercise moves. The first platform pad 81 may comprise a hard surface or a soft surface.

The first end platform 80 may comprise a main portion 82 and an extended portion 83 such as shown in FIG. 1. The main portion 82 may be wider than the extended portion 83 as shown in the figures, with the extended portion 83 serving as a connection point for a first platform handle 84 which is connected to the first end platform 80. In the exemplary embodiment shown in the figures, the extended portion 83 faces the second end 22 of the frame 20 of the exercise machine 10, though a reverse configuration could be utilized. Further, it should be appreciated that the shape, structure, and configuration of the first end platform handle 84 may vary in different embodiments. In some embodiments, the first end platform handle 84 may be omitted.

The second end platform 85 may comprise a main portion 87 and an extended portion 88 such as shown in FIG. 1. The main portion 87 may be wider than the extended portion 88 as shown in the figures, with the extended portion 88 serving as a connection point for a second platform handle 89 which is connected to the second end platform 85. In the exemplary embodiment shown in the figures, the extended portion 88 faces the first end 21 of the frame 20 of the exercise machine 10, though a reverse configuration could be utilized. Further, it should be appreciated that the shape, structure, and configuration of the second end platform handle 89 may vary in different embodiments. In some embodiments, the second end platform handle 89 may be omitted.

Figure 2A:
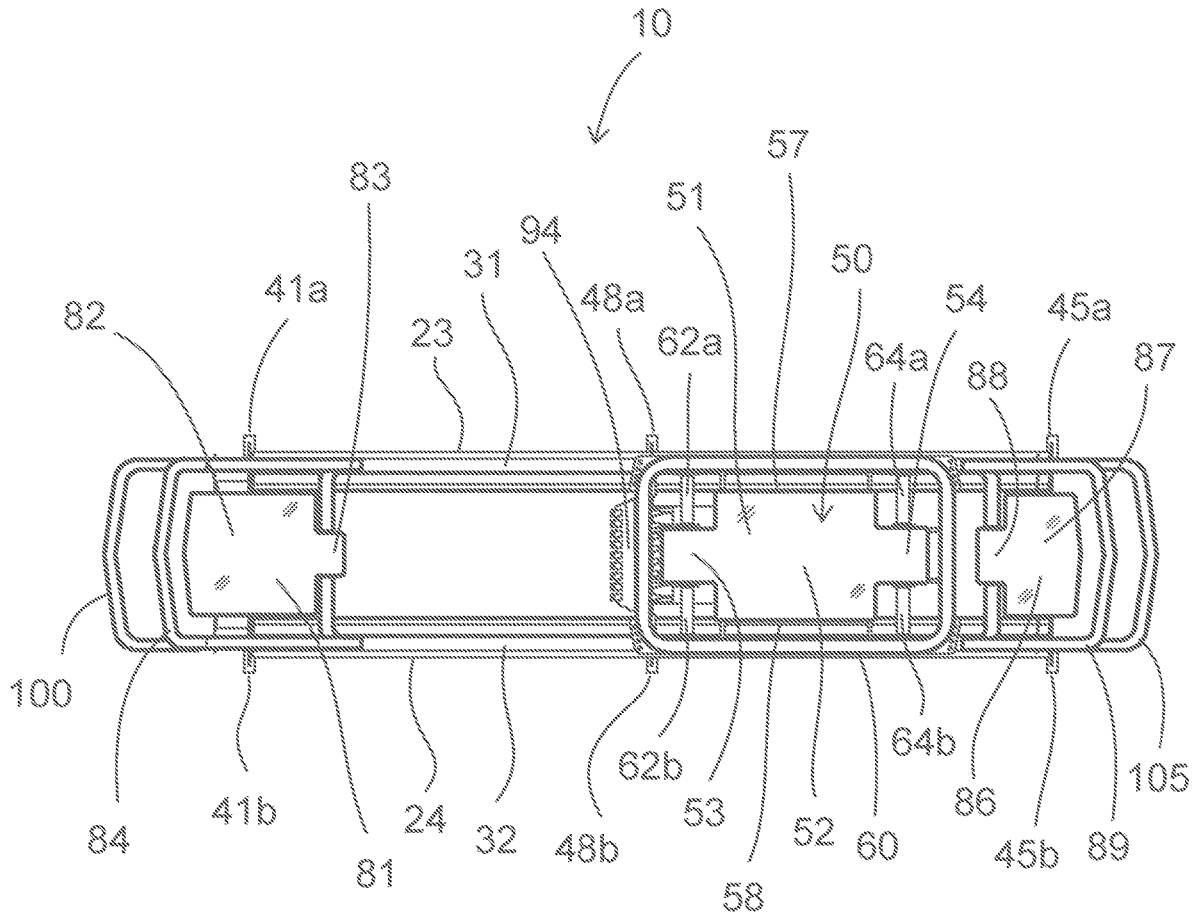
FIG. 2A is a top view of an exercise machine in accordance with an example embodiment.
Figure 2B:
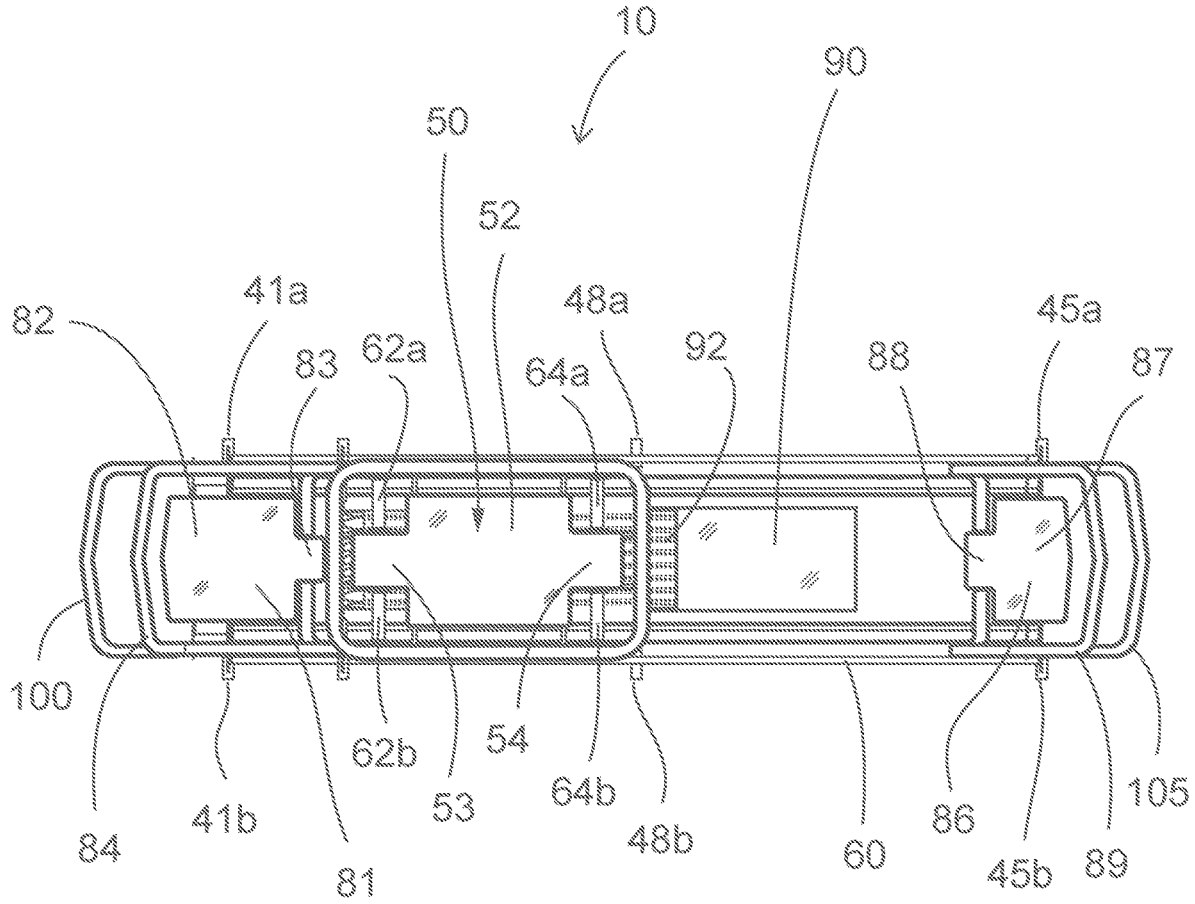
FIG. 2B is a top view of an exercise machine with the carriage having been moved in accordance with an example embodiment.
Figure 3:
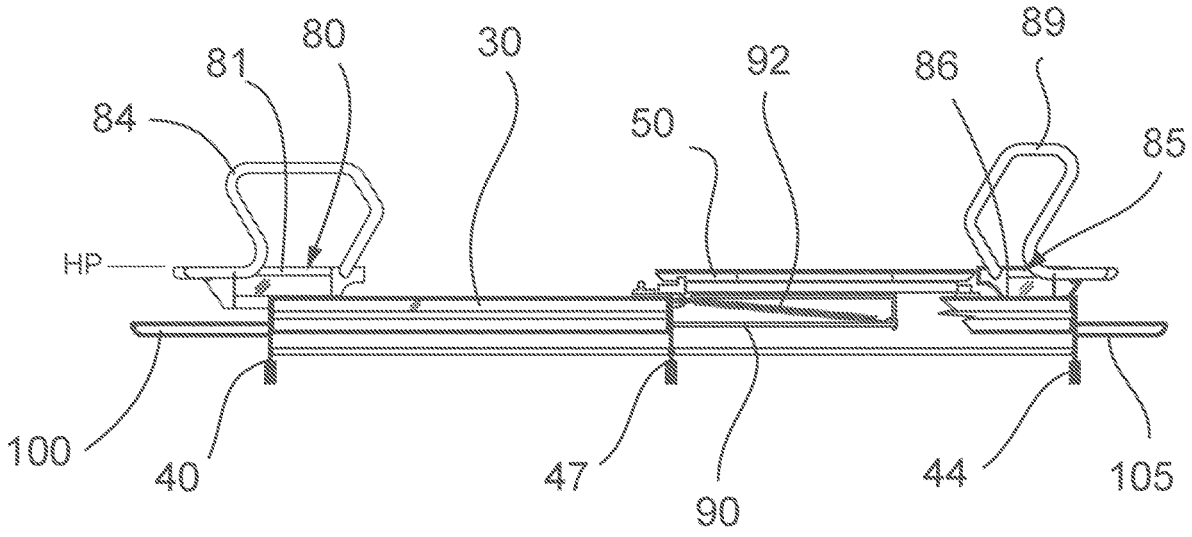
FIG. 3 is a side view of an exercise machine in accordance with an example embodiment.
Figure 4:
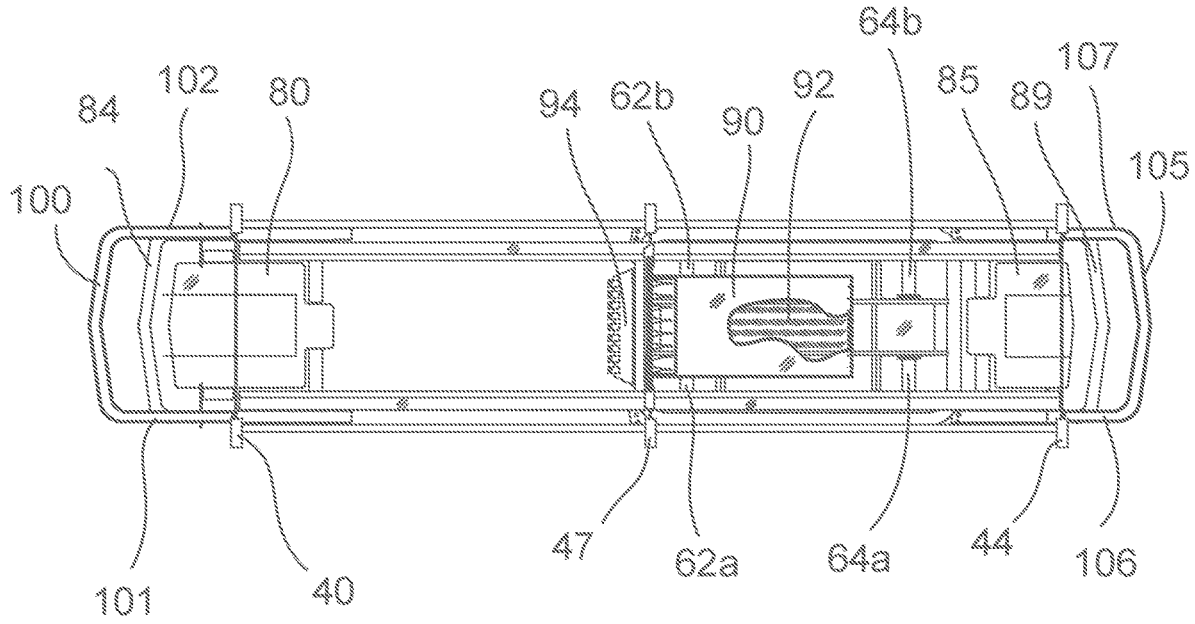
FIG. 4 is a bottom view of an exercise machine in accordance with an example embodiment.
Figure 5:
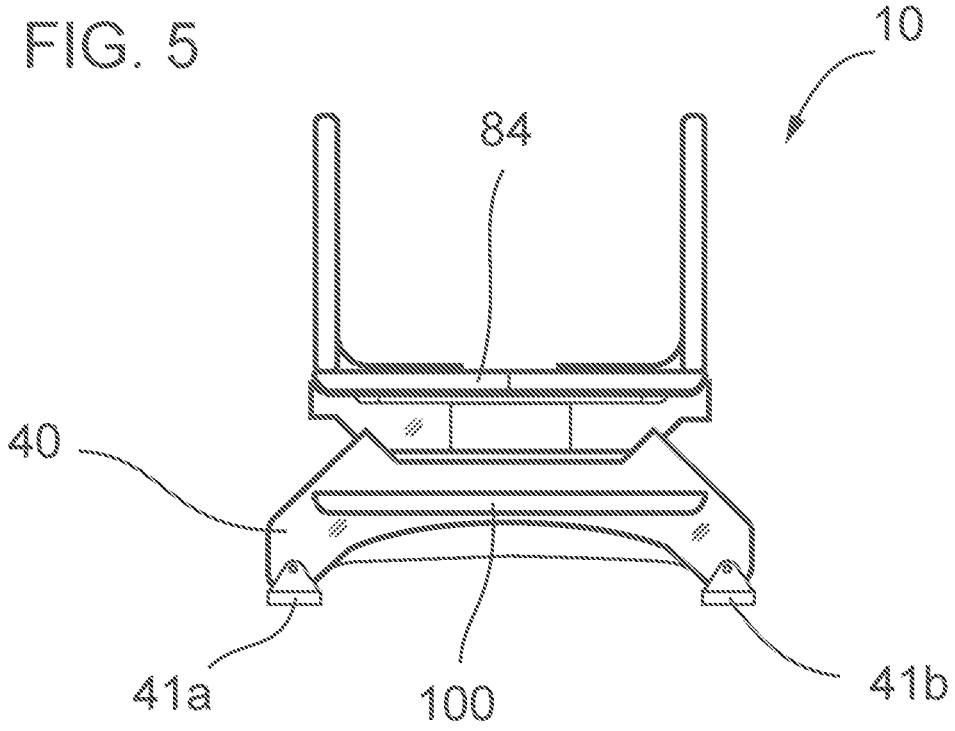
FIG. 5 is a first end view of an exercise machine in accordance with an example embodiment.
Figure 6:
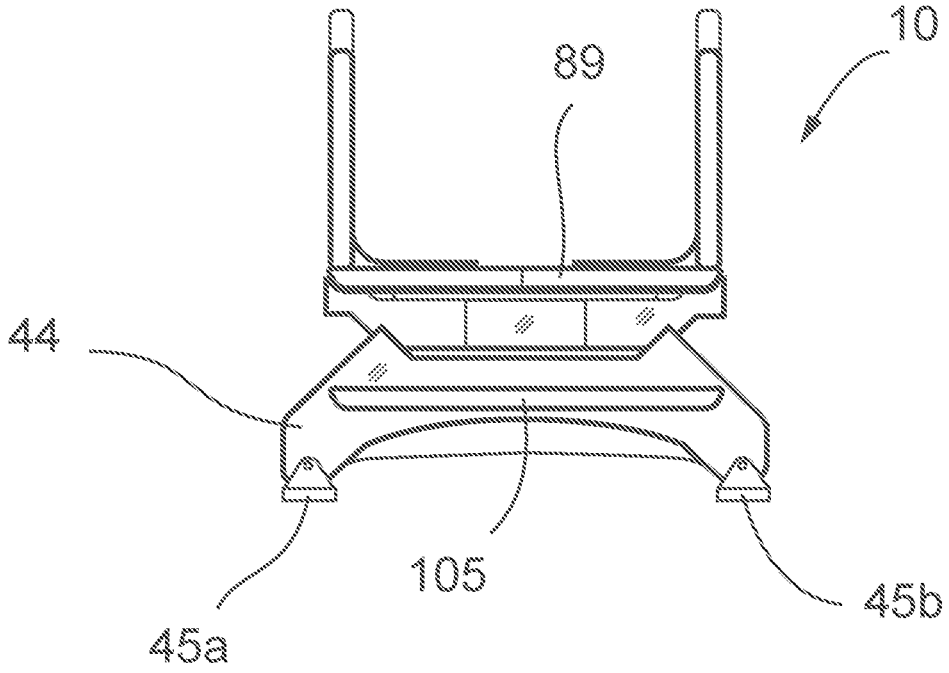
FIG. 6 is a second end view of an exercise machine in accordance with an example embodiment.

As best shown in FIGS. 2A-4, the exercise machine 10 may include one or more bias members 92 which are connected to the carriage 50 so as to provide a biasing force against movement of the carriage 50 in a certain direction. The type of bias member 92 utilized may vary in different embodiments, including but not limited to various types of springs, elastic bands, linkages, and the like. Generally, one end of each bias member 92 will be coupled with the exercise machine 10, such as to a structural element of the frame 20, with the other end of each bias member 92 being removably coupled to the carriage 50, such as by use of carriage bias receivers 94 as discussed below.

Where multiple bias members 92 are utilized, one or more of the bias members 92 may be selectively and removably connected to the carriage 50 so as to select a desired level of resistance against movement of the carriage 50. When not connected to the carriage 50, the bias members 92 may be secured to a bias member retainer 90 as best shown in FIGS. 2B, 3, and 4. The bias member retainer 90 may comprise a structure which is connected to the exercise machine 10 and which stores and holds the bias members 92. In an exemplary embodiment, the bias member retainer 90 may comprise a spring box.

Generally, one end of each bias member 92 will be fixedly secured to the bias member retainer 90. The opposite end of each bias member 92 will be removably connected to the bias member retainer 90 in a manner that each bias member 92 may be selectively disconnected from the bias member retainer 90 and selectively and removably connected to a carriage bias receiver 94 on the carriage 50 itself. The bias member retainer 90 includes an opening 91 through and out of which the bias members 92 each extend.

Various types of bias member retainers 90 may be utilized. Generally, the bias member retainer 90 may comprise a frame of structural elements, such as brackets or the like, which partially cover the bias members 92 so as to prevent an exerciser from accidentally coming in contact with the bias members 92 when exercising. In some embodiments, the bias member retainer 90 may comprise an enclosed, box-like structure which stores the bias members 92, with ends of the bias members 92 extending out of the opening 91 of the bias member retainer 90 to be selectively removed and connected to a carriage bias receiver 94 on the carriage 50. In some embodiments, the bottom of the bias member retainer 90 may be open (and not enclosed) such that the bias members 92 may be easily accessed from underneath the exercise machine 10 as needed for service. The sides of the bias member retainer 90 will generally be covered or enclosed so as to prevent accidental injury to the exerciser when performing exercise moves on the exercise machine 10.

Generally, the bias member retainer 90 will include anchor points to which the removable ends of the bias members 92 may be removably connected. As needed, an exerciser may remove the removable ends of the bias members 92 from the anchoring points of the bias member retainer 90 and connect the removable ends of the bias members 92 to the carriage bias receiver 94 to impart a resistance force against movement of the carriage 50 in a certain direction. The anchoring points may comprise slots in which the ends of the bias members 92 are retained, such as by use of knobs or other protrusions on the ends of the bias members 92 which may be removably secured in such slots.

The positioning of the bias member retainer 90 may vary in different embodiments. In an exemplary embodiment, the bias member retainer 90 may be centrally located between the respective ends 21, 22 of the frame 20 of the exercise machine 10. In the exemplary embodiment shown in FIG. 4, in which the bias member retainer 90 includes a front end and a rear end, the front end of the bias member retainer 90 is shown as being connected at the mid-point between the respective ends 21, 22 of the frame 20, with the rear end of the bias member retainer 90 being closer to the second end 22 of the frame 20. The opposite configuration may be utilized in some embodiments. In some embodiments, the bias member retainer 92 may be positioned directly underneath the carriage 50 when the carriage 50 is in its resting position such as shown in FIGS. 3 and 4.

The manner in which the bias member retainer 90 is connected to the exercise machine 10 may vary in different embodiments. The figures illustrate an embodiment in which the bias member retainer 90 is secured underneath the track 30 of the exercise machine 10. The bias member retainer 90 may be connected to the frame 20 of the exercise machine 10 underneath the track 30. The bias member retainer 90 may be connected to the underside of the track 30 in some embodiments, though in the embodiment shown in the figures, it can be seen that the bias member retainer 90 is not in contact with either rail 31, 32 of the track 30. However, in embodiments which utilize a monorail track 30, the bias member retainer 90 may be secured or connected to the underside of such a monorail track 30. The bias member retainer 90 may be connected to the exercise machine 10 by various methods, such as but not limited to welding, fasteners, clamps, brackets, and the like.

As shown in FIG. 4, the carriage 50 may include a carriage bias receiver 94 to which the removable ends of the bias members 92 may be selectively and removably connected. The carriage bias receivers 94 may comprise slotted plates or other types of structural elements which include anchoring points for the ends of the bias members 94. In one exemplary embodiment, the carriage bias receivers 94 may comprise slots into which the ends of the bias members 92 may be secured and retained, such as by use of knobs or other protrusions on the ends of the bias members 92 which may be removably secured in such slots.

C. Carriage.

As shown throughout the figures, the exercise machine 10 includes a carriage 50 which is movably connected to the track 30. The carriage 50 may be adapted to move or slide along at least a portion of the track 30 between its first end 33 and second end 34. In some embodiments, the carriage 50 may be adapted to move back and forth, such as by reciprocating, along the entire length of the track 30. In other embodiments, the carriage 50 may be adapted to move back and forth along only a portion of the track 30.

Figure 10:
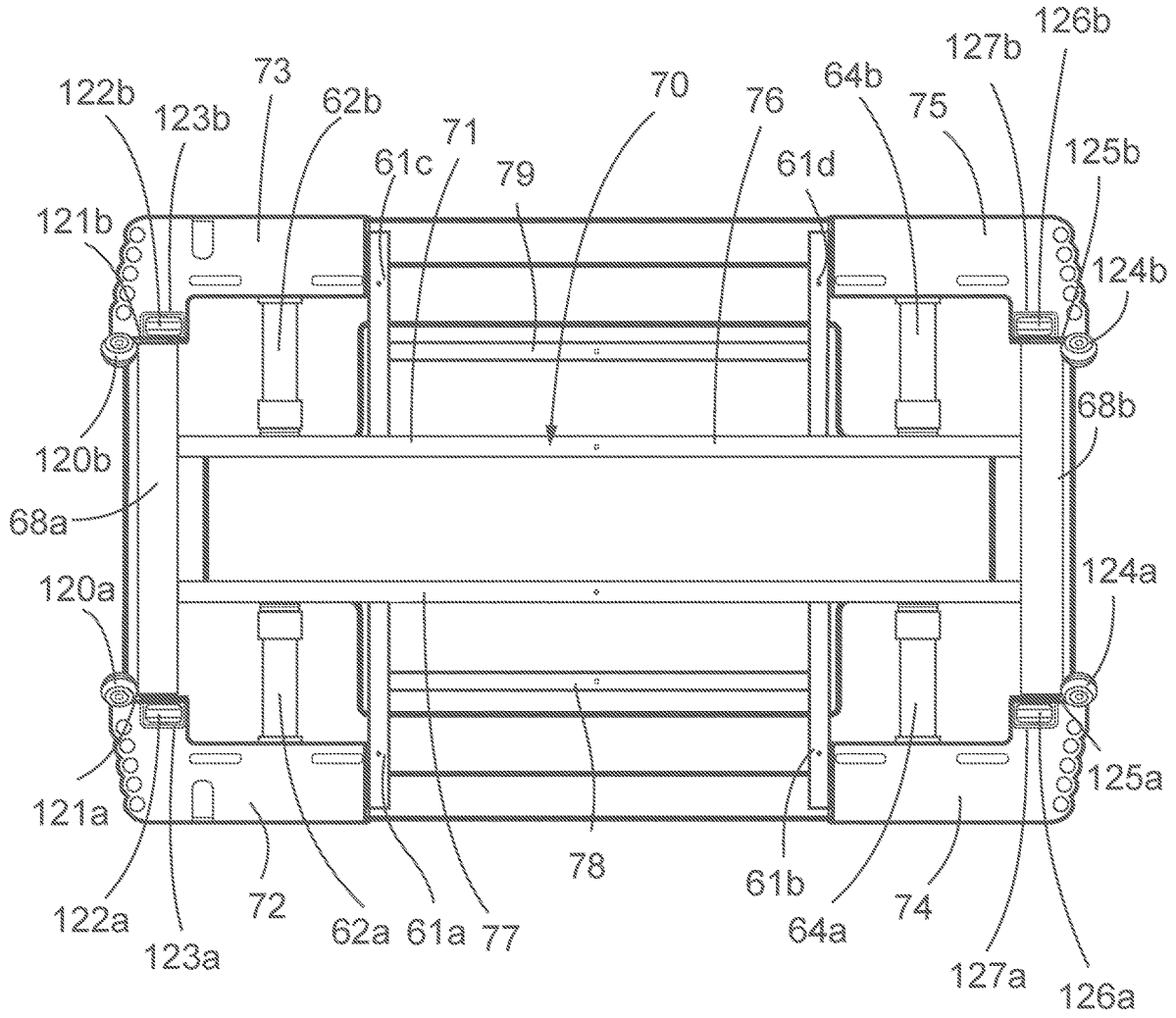
FIG. 10 is a bottom view of an exemplary carriage for use with an exercise machine in accordance with an example embodiment.

The carriage 50 will generally include a carriage platform 51 on which an exerciser will rest various body parts while performing various exercise moves. As shown in FIGS. 8 and 10, the carriage platform 51 may comprise a first end 55, a second end 56, a first side 57, and a second side 58. The carriage platform 51 may be padded for comfort. The carriage platform 51 may comprise various shapes and sizes. In the exemplary embodiment shown in the figures, the carriage platform 51 comprises a wide central portion 52 which is sandwiched between a pair of narrower end portions 53, 54.

More specifically, the central portion 52 of the carriage platform 51 may comprise a wider structure to support the body of the exerciser as needed. The first end portion 53 extends outwardly from a first end of the central portion 52 and is narrower than the central portion 52. The second end portion 54 extends outwardly in an opposite direction from a second end of the central portion 52 and is also narrower than the central portion 52, with the first and second end portions 52, 53 comprising the same width.

As shown throughout the figures, the carriage may include a plurality of wheels 120*a*, 120*b*, 122*a*, 122*b*, 124*a*, 124*b*, 126*a*, 126*b* which are utilized to traverse the track 30, with each of the wheels 120*a*, 120*b*, 122*a*, 122*b*, 124*a*, 124*b*, 126*a*, 126*b* being positioned so as to contact and run along the track 30. Each of the wheels 120*a*, 120*b*, 122*a*, 122*b*, 124*a*, 124*b*, 126*a*, 126*b* is generally coupled (directly or indirectly connected) to the underside of the carriage 50 such as shown in FIGS. 9-11 by brackets 121*a*, 121*b*, 123*a*, 123*b*, 125*a*, 125*b*, 127*a*, 127*b* as shown in the figures.

Figure 9:
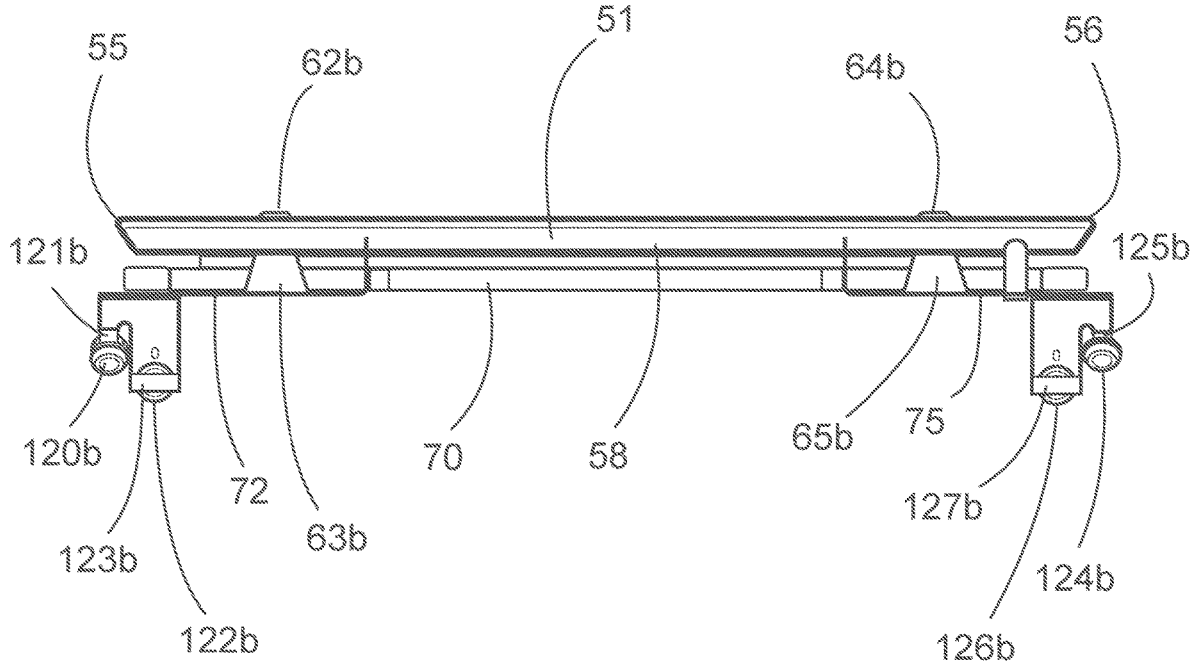
FIG. 9 is an end view of an exemplary carriage for use with an exercise machine in accordance with an example embodiment.
Figure 11:
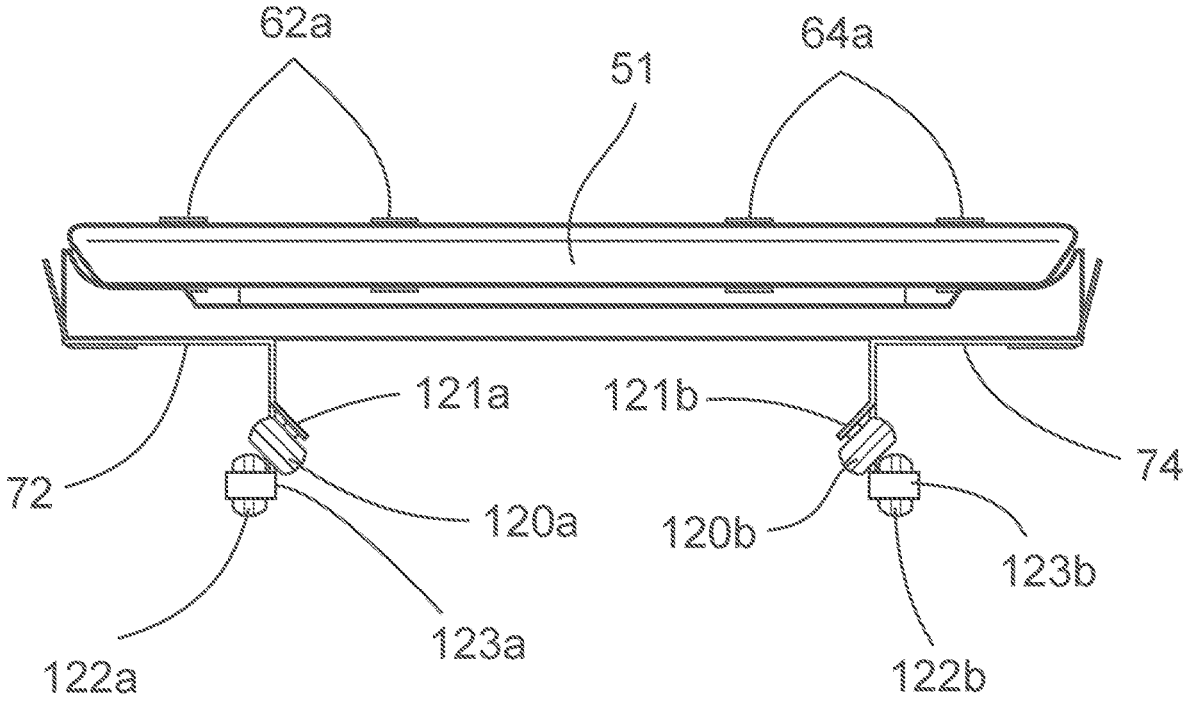
FIG. 11 is a side view of an exemplary carriage for use with an exercise machine in accordance with an example embodiment.

Continuing to reference FIGS. 9-11, it can be seen that a combination of diagonal wheels 120*a*, 120*b*, 124*a*, 124*b* and vertical wheels 122*a*, 122*b*, 126*a*, 126*b* may be utilized. The use of a combination of diagonal wheels 120*a*, 120*b*, 124*a*, 124*b* and vertical wheels 122*a*, 122*b*, 126*a*, 126*b* limits slippage and other lateral movements such as jostling as the carriage 50 traverses the track 30. In some embodiments, only diagonal wheels 120*a*, 120*b*, 124*a*, 124*b* or only vertical wheels 122*a*, 122*b*, 126*a*, 126*b* may be utilized, rather than a combination thereof as shown in the exemplary embodiments of the exemplary figures.

As best shown in FIG. 10, a plurality of diagonal wheels 120*a*, 120*b*, 124*a*, 124*b* may be connected to the carriage by a plurality of diagonal wheel brackets 121*a*, 121*b*, 125*a*, 125*b*. In the exemplary embodiment shown in the figures, it can be seen that a first front diagonal wheel 120*a* may be connected to the underside of the carriage 50 at or near the first end 55 of the carriage 50. Similarly, a second front diagonal wheel 120*b* may be connected to the underside of the carriage 50 at or near the first end 55 of the carriage 50. The first front diagonal wheels 120*a* may be positioned near the first side 57 of the carriage 50 and the second front diagonal wheel 120*b* may be positioned near the second side 58 of the carriage 50.

With reference to FIGS. 9-11, it can be seen that each of the front diagonal wheels 120*a*, 120*b* are connected to the underside of the carriage 50 by front diagonal wheel brackets 121*a*, 121*b*. The front diagonal wheel brackets 121*a*, 121*b* may be directly connected to the carriage 50, or may be connected to the support frame 71 of the support assembly 70 on the underside of the carriage 50. In the exemplary embodiment shown in the figures, the first front diagonal wheel bracket 121*a* is shown as being connected to the first front support 72 of the support assembly 70 and the second front diagonal wheel bracket 121*b* is shown as being connected to the second front support 73 of the support assembly 70.

Continuing to reference FIG. 10, it can be seen that a first rear diagonal wheel 124*a* may be connected to the underside of the carriage 50 at or near the second end 56 of the carriage 50. Similarly, a second rear diagonal wheel 124*b* may be connected to the underside of the carriage 50 at or near the second end 56 of the carriage 50. The first rear diagonal wheels 124*a* may be positioned near the first side 57 of the carriage 50 and the second rear diagonal wheel 124*b* may be positioned near the second side 58 of the carriage 50.

With reference to FIGS. 9-11, it can be seen that each of the rear diagonal wheels 124*a*, 124*b* are connected to the underside of the carriage 50 by rear diagonal wheel brackets 125*a*, 125*b*. The rear diagonal wheel brackets 125*a*, 125*b* may be directly connected to the carriage 50, or may be connected to the support frame 71 of the support assembly 70 on the underside of the carriage 50. In the exemplary embodiment shown in the figures, the first rear diagonal wheel bracket 125*a* is shown as being connected to the first rear support 74 of the support assembly 70 and the second rear diagonal wheel bracket 125*b* is shown as being connected to the second rear support 75 of the support assembly 70.

As best shown in FIG. 10, a plurality of vertical wheels 122*a*, 122*b*, 126*a*, 126*b* may be connected to the carriage by a plurality of vertical wheel brackets 123*a*, 123*b*, 127*a*, 127*b*. In the exemplary embodiment shown in the figures, it can be seen that a first front vertical wheel 122*a* may be connected to the underside of the carriage 50 at or near the first end 55 of the carriage 50. Similarly, a second front vertical wheel 122*b* may be connected to the underside of the carriage 50 at or near the first end 55 of the carriage 50. The first front vertical wheel 122*a* may be positioned near the first side 57 of the carriage 50 and the second front vertical wheel 122*b* may be positioned near the second side 58 of the carriage 50.

With reference to FIGS. 9-11, it can be seen that each of the front vertical wheels 122*a*, 122*b* are connected to the underside of the carriage 50 by front vertical wheel brackets 123*a*, 123*b*. The front vertical wheel brackets 123*a*, 123*b* may be directly connected to the carriage 50, or may be connected to the support frame 71 of the support assembly 70 on the underside of the carriage 50. In the exemplary embodiment shown in the figures, the first front vertical wheel bracket 123*a* is shown as being connected to the first front support 72 of the support assembly 70 and the second front vertical wheel bracket 123*b* is shown as being connected to the second front support 73 of the support assembly 70.

Continuing to reference FIG. 10, it can be seen that a first rear vertical wheel 126*a* may be connected to the underside of the carriage 50 at or near the second end 56 of the carriage 50. Similarly, a second rear vertical wheel 126*b* may be connected to the underside of the carriage 50 at or near the second end 56 of the carriage 50. The first rear vertical wheel 126*a* may be positioned near the first side 57 of the carriage 50 and the second rear vertical wheel 126*b* may be positioned near the second side 58 of the carriage 50.

With reference to FIGS. 9-11, it can be seen that each of the rear vertical wheels 126*a*, 126*b* are connected to the underside of the carriage 50 by rear vertical wheel brackets 127*a*, 127*b*. The rear vertical wheel brackets 127*a*, 127*b* may be directly connected to the carriage 50, or may be connected to the support frame 71 of the support assembly 70 on the underside of the carriage 50. In the exemplary embodiment shown in the figures, the first rear vertical wheel bracket 127*a* is shown as being connected to the first rear support 74 of the support assembly 70 and the second rear vertical wheel bracket 127*b* is shown as being connected to the second rear support 75 of the support assembly 70.

As shown in FIG. 11, the vertical wheels 122*a*, 122*b*, 126*a*, 126*b* are positioned lower than the diagonal wheels 120*a*, 120*b*, 124*a*, 124*b*. In this manner, the vertical wheels 122*a*, 122*b*, 126*a*, 126*b* may engage with and run across the lower end of the rails 31, 32 of the track 30 and the diagonal wheels 120*a*, 120*b*, 124*a*, 124*b* may engage with and run across a side of the rails 31, 32 of the track 30. In different embodiments, the vertical wheels 122*a*, 122*b*, 126*a*, 126*b* may instead be above the diagonal wheels 120*a*, 120*b*, 124*a*, 124*b* such that the vertical wheels 122*a*, 122*b*, 126*a*, 126*b* instead engage with the top side of the rails 31, 32 of the track 30.

In the exemplary embodiment shown in the figures, the first front diagonal wheel 120*a*, first rear diagonal wheel 124*a*, first front vertical wheel 122*a*, and first rear vertical wheel 126*a* will each engage with a first rail 31 of the track 30. Similarly, the second front diagonal wheel 120*b*, second rear diagonal wheel 124*b*, second front vertical wheel 122*b*, and second rear vertical wheel 126*b* will engage with the second rail 32 of the track 30. In embodiments which utilize a monorail track 30, all wheels 120*a*, 120*b*, 122*a*, 122*b*, 124*a*, 124*b*, 126*a*, 126*b* may engage with the monorail track 30.

D. Outer Handle.

As shown in FIGS. 1, 2A, 2B, 8A, 8B, and 10, an outer handle 60 may be connected to a support assembly 70 so as to surround the carriage platform 51. The outer handle 60 may extend around the carriage platform 51, with the carriage platform 51 being positioned within the inner perimeter of the outer handle 60. Thus, the outer handle 60 may be positioned to surround the outer perimeter of the carriage platform 51.

The outer handle 60 may comprise a single, continuous handle such as shown in FIGS. 1, 2A, 2B, and 8. In other embodiments, the outer handle 60 may comprise separate handles which are interconnected or coupled together to form the continuous outer handle 60. The outer handle 60 may be comprised of a substantially triangular cross-section such as shown in the figures such that an exerciser may encircle his/her hand around the outer handle 60 at various positions on the outer handle 60 to perform various exercise moves. It should be appreciated, however, that the cross-sectional shape of the outer handle 60 could vary in different embodiments, such as, for example and without limitation, a circular, ovular, square-shaped, or polygonal cross-section.

The outer handle 60 is illustrated as comprising a rectangular-shaped handle with curved corners 144, 145, 146, 147, but may comprise various other shapes and structures in different embodiments. In some embodiments, the outer handle 60 may be circular so as to surround the carriage platform 51. In other embodiments, the outer handle 60 may comprise non-curved corners, such as corners which form right angles.

Figure 18:
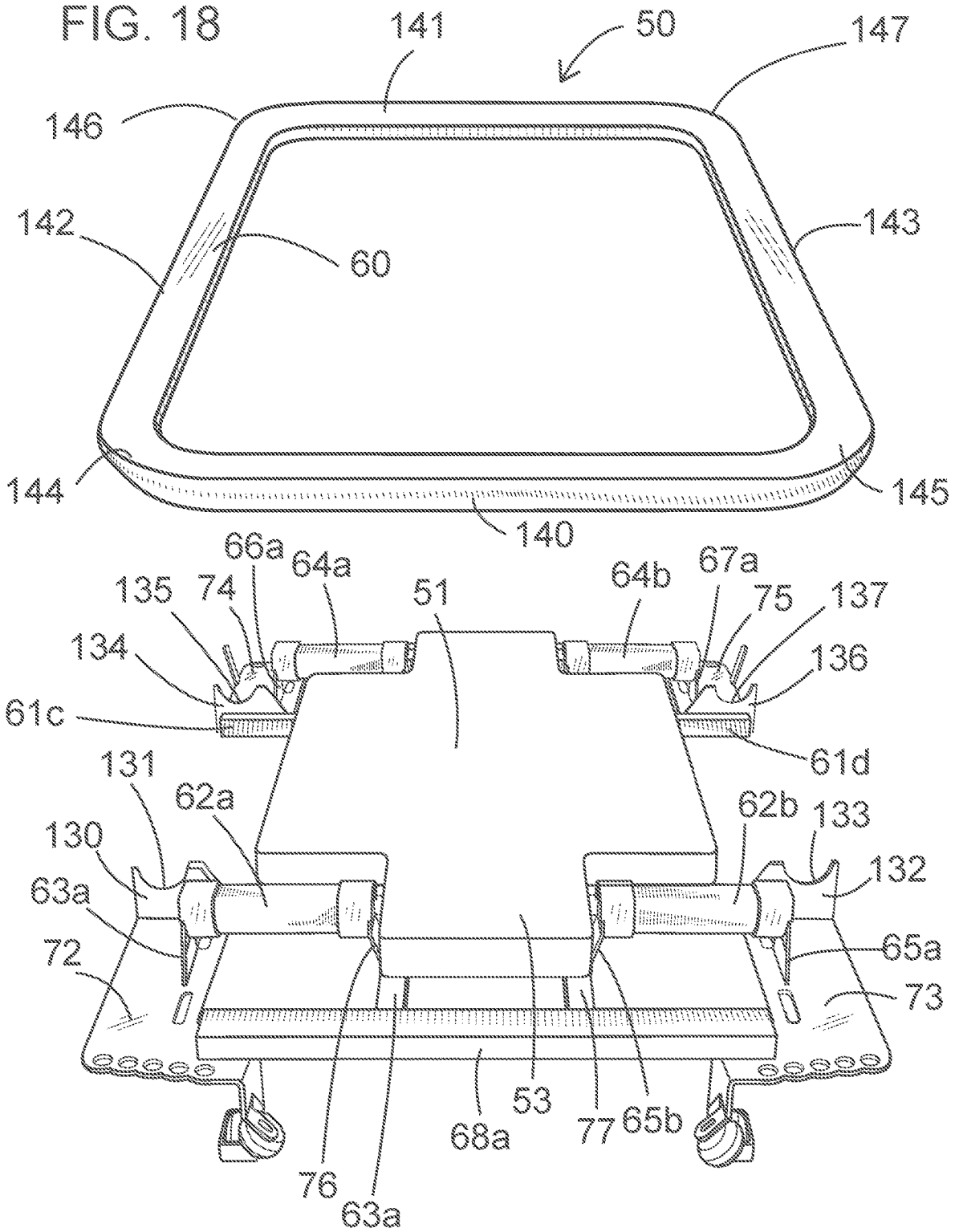
FIG. 18 is an exploded perspective view of a carriage with the outer handle removed of an exercise machine in accordance with an example embodiment.

As best shown in FIG. 18, the outer handle 60 may comprise a first end 140, a second end 141 opposite the first end 140, a first side 142, and a second side 143 opposite the first side 142. The outer handle 60 may be integrally formed, or may be comprised of interconnected portions. The outer handle 60 may include a first corner 144 linking the first side 142 and first end 140 of the outer handle 60, a second corner 145 linking the second side 143 and first end 140 of the outer handle 60, a third corner 146 linking the first side 142 and second end 141 of the outer handle 60, and a fourth corner 147 linking the second side 143 and second end 141 of the outer handle 60. While the figures illustrate an embodiment in which the outer handle 60 comprises four corners 144, 145, 146, 147, it should be appreciated that more or less corners 144, 145, 146, 147 may be utilized in different embodiments.

As shown in the figures, the outer handle 60 is distally-spaced with respect to the carriage platform 51 such that an exerciser may place his/her fingers, hands, toes, feet, or other body parts between the outer handle 60 and the carriage platform 51. In the exemplary embodiment shown in FIGS. 1, 2A, 2B, and 8A, it can be seen that the outer handle 60 extends around the carriage platform 51 of the carriage 50 to form a continuous loop, with gaps or spaces being present between all portions of the carriage platform 51 and the outer handle 50. The outer handle 60 thus is not directly connected to, or in contact with, the carriage platform 51 at any point. Instead, the outer handle 60 is only indirectly connected to the carriage platform 51 by the support frame 71.

Figure 8A:
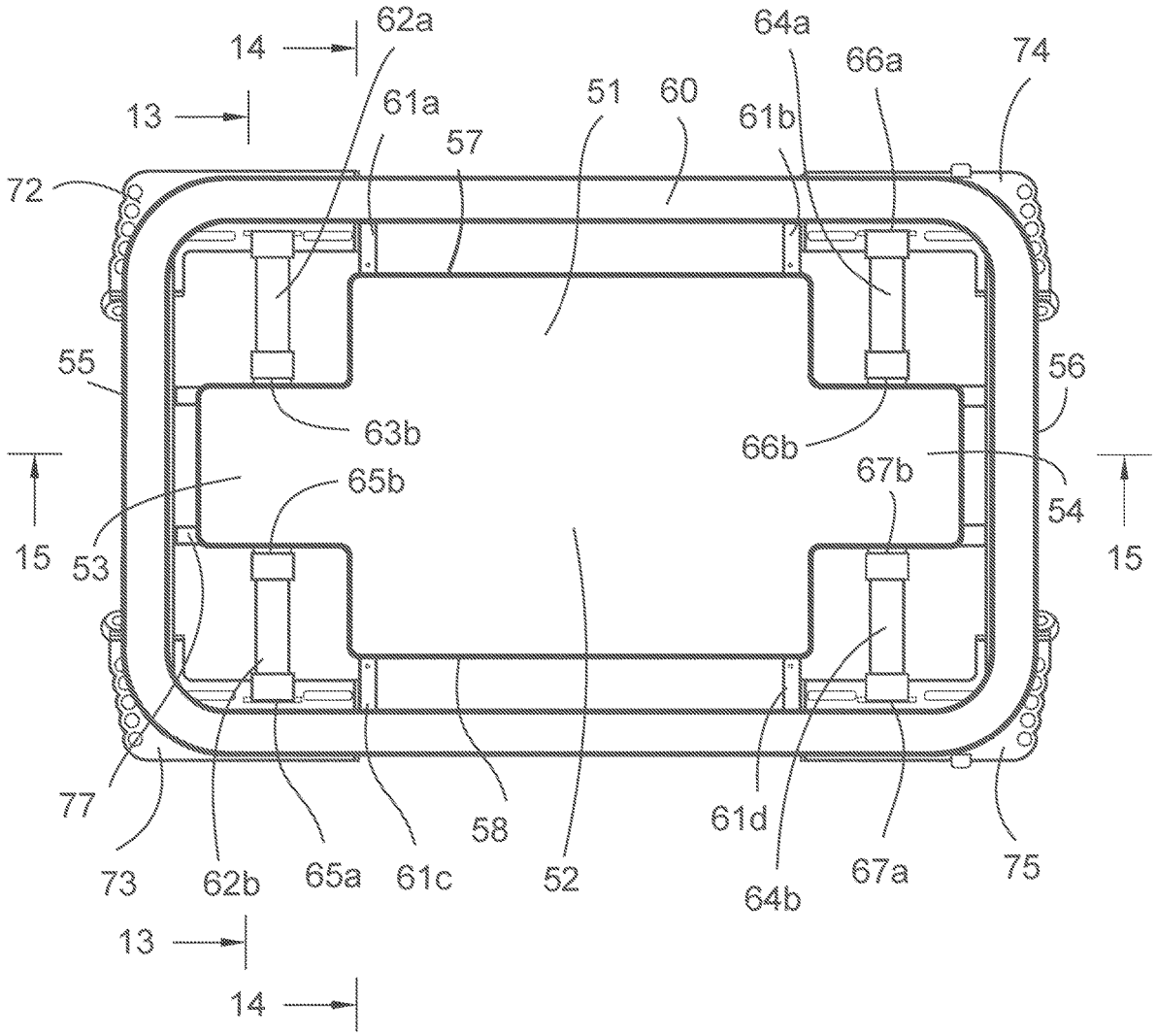
FIG. 8A is a top view of an exemplary carriage for use with an exercise machine in accordance with an example embodiment.

As best shown in FIGS. 8A and 10, the outer handle 60 may be connected to a support frame 71, with the support frame 71 being connected to the lower end of the outer handle 60 in the exemplary embodiment shown in the figures. However, it should be appreciated that, in some embodiments, one or more structural elements of the support frame 71 may instead be connected to the inner side of the outer handle 60. The figures illustrate an embodiment in which the outer handle 60 is not directly connected to the carriage 50, but is instead connected to the same support frame 71 to which the carriage 50 is connected. In this manner, the outer handle 60 and carriage 50 may be interconnected by the support frame 71. In some embodiments, however, the outer handle 60 may at one or positions be connected directly to the carriage 50.

Figure 8B:
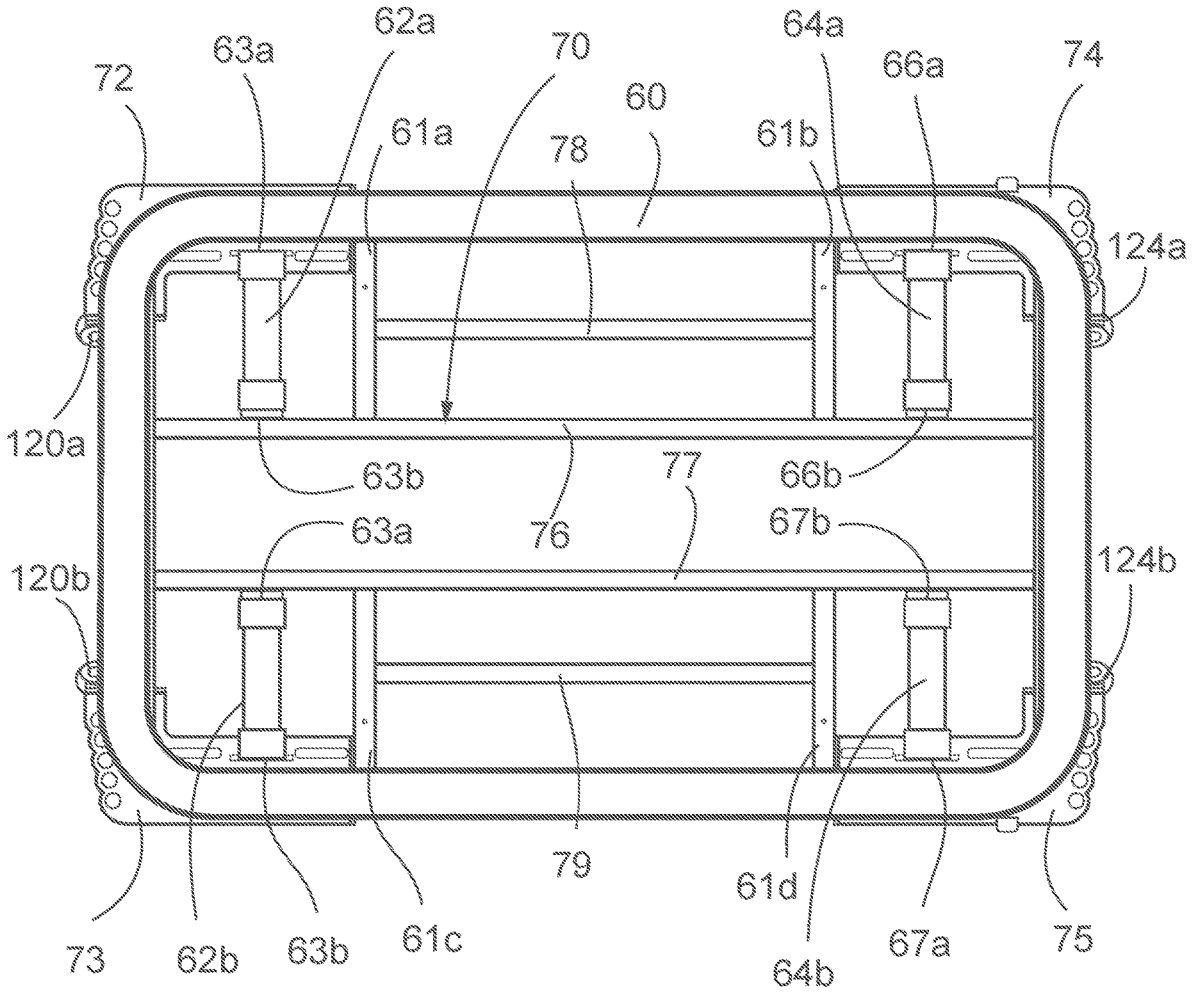
FIG. 8B is a top view of an exemplary carriage support frame for use with an exercise machine in accordance with an example embodiment.

As best shown in FIGS. 8B and 10, the support frame 71, which is discussed in more detail below, may include front supports 72, 73 and rear supports 74, 75 which are connected to the outer handle 60. In the exemplary embodiment shown in FIGS. 8A-11, it can be see that the first front support 72, the second front support 73, the first rear support 74, and the second rear support 75 are each connected at a respective corner of the outer handle 60.

Each of the supports 72, 73, 74, 75 may include a bracket, fastener, or the like which connected or secures the outer handle 60 to the support frame 71. In the exemplary embodiments shown in FIGS. 8A and 10, it can be seen that the first front support 72 includes a first front bracket 130, the second front support 73 includes a second front bracket 132, the first rear support 74 includes a first rear bracket 134, and the second rear support 75 includes a second rear bracket 136.

Each of the brackets 130, 132, 134, 136 may comprise a plate-like member which extends upwardly from the respective front and rear supports 72, 73, 74, 75. In the figures, the brackets 130, 132, 134, 136 each extend at a right angle with respect to their respective underlying supports 72, 73, 74, 75. However, in certain embodiments, the brackets 130, 132, 134, 136 may extend at other angles from the underlying supports 72, 73, 74, 75. Thus, the brackets 130, 132, 134, 136 may extend vertically upward, or may extend diagonally upward.

Each of the brackets 130, 132, 134, 136 includes a cutout 131, 133, 135, 137 in which the outer handle 60 is positioned and secured as discussed herein and shown in FIG. 18. The shape and size of the cutouts 131, 133, 135, 137 may vary in different embodiments. In the exemplary embodiments shown in the figures, the cutouts 131, 133, 135, 137 are shown as comprising a substantially semi-circular shape. In other embodiments, various other shapes may be utilized, such as but not limited to V-shaped and U-shaped cutouts 131, 133, 135, 137. Thus, the scope should not be construed as limited to any particular shape or size of cutout 131, 133, 135, 137 so long as the outer handle 60 may be positioned within and secured to the cutouts 131, 133, 135, 137.

The manner in which the outer handle 60 is connected to the brackets 130, 132, 134, 136 may vary in different embodiments. The outer handle 60 may be positioned within and secured within the cutouts 131, 133, 135, 137 of each bracket 130, 132, 134, 136 in different manners. By way of example and without limitation, the outer handle 60 may be secured by use of adhesives, welding, clamps, fasteners, ties, and the like.

As shown in FIG. 18, the first front support 72 includes a first front bracket 130 which extends upwardly from the first front support 72. The first front bracket 130 includes a first front cutout 131 within which a portion of the outer handle 60 may be positioned and secured. In the exemplary embodiment shown in the figures, the first front bracket 130 is positioned underneath the first side 142 of the outer handle 60 near the first end 140 of the outer handle 60. Thus, the first front bracket 130 may be positioned underneath the first side 142 of the outer handle 60 near the first corner 144 of the outer handle 60. It should be appreciated, however, that the first front bracket 130 may be positioned at other locations along the outer handle 60 in different embodiments.

The second front support 73 includes a second front bracket 132 which extends upwardly from the second front support 73. The second front bracket 132 includes a second front cutout 133 within which a portion of the outer handle 60 may be positioned and secured. In the exemplary embodiment shown in the figures, the second front bracket 132 is positioned underneath the second side 143 of the outer handle 60 near the first end 140 of the outer handle 60. Thus, the second front bracket 132 may be positioned underneath the second side 143 of the outer handle 60 near the second corner 145 of the outer handle 60. It should be appreciated, however, that the second front bracket 132 may be positioned at other locations along the outer handle 60 in different embodiments.

The first rear support 74 includes a first rear bracket 134 which extends upwardly from the first rear support 74. The first rear bracket 134 includes a first rear cutout 135 within which a portion of the outer handle 60 may be positioned and secured. In the exemplary embodiment shown in the figures, the first rear bracket 134 is positioned underneath the first side 142 of the outer handle 60 near the second end 141 of the outer handle 60. Thus, the first rear bracket 134 may be positioned underneath the first side 142 of the outer handle 60 near the third corner 146 of the outer handle 60. It should be appreciated, however, that the first rear bracket 134 may be positioned at other locations along the outer handle 60 in different embodiments.

The second rear support 75 includes a second rear bracket 136 which extends upwardly from the second rear support 75. The second rear bracket 136 includes a second rear cutout 137 within which a portion of the outer handle 60 may be positioned and secured. In the exemplary embodiment shown in the figures, the second rear bracket 134 is positioned underneath the second side 143 of the outer handle 60 near the second end 141 of the outer handle 60. Thus, the second rear bracket 136 may be positioned underneath the second side 143 of the outer handle 60 near the fourth corner 147 of the outer handle 60. It should be appreciated, however, that the second rear bracket 136 may be positioned at other locations along the outer handle 60 in different embodiments.

In this manner, the outer handle 60 may be connected to the support frame 71, which itself is connected to and supports the carriage platform 51. Thus, the outer handle 60 is not in contact with or directly connected with the carriage platform 51. Although the figures illustrate four points of connection between the outer handle 60 and the support frame 71 (the front brackets 130, 132 of the front supports 72, 73 connected to the underside near the front corners 144, 145 of the outer handle 60 and the rear brackets 134, 136 of the rear supports 74, 75 connected to the underside near the rear corners 146, 147 of the outer handle 60), it should be appreciated that more or less connection points may be utilized to secure the outer handle 60 to the underlying support frame 71 such that the outer handle 60 extends around, but is not directly connected to, the carriage platform 51.

The outer handle 60 is configured such that an exerciser may grasp the outer handle 60 at a wide range of locations surrounding the carriage platform 51. By limiting the connection points between the outer handle 60 and the carriage platform 51, the exerciser is provided a wide range of grasping points both on the outer handle 60 and on the outer edges of the carriage platform 51 itself. The gap or space between the carriage platform 51 and the outer handle 60 allows an exerciser to place his/her feet, hands, fingers, etc. between the carriage platform 51 and the outer handle 60 so as to grasp the outer handle 60 and/or the carriage platform 51 when performing a wide range of exercise moves.

E. Inner Handles.

As best shown in FIGS. 1, 2A, 2B, 4, 8A, 8B, and 10, the carriage 50 may include inner handles 62*a*, 62*b*, 64*a*, 64*b*. Each of the inner handles 62*a*, 62*b*, 64*a*, 64*b* may be positioned between the carriage platform 51 and the outer handle 60, but none of the inner handles 62*a*, 62*b*, 64*a*, 64*b* are connected directly to, or in contact with, either the carriage platform 51 or the outer handle 60. As shown in the figures, none of the inner handles 62*a*, 62*b*, 64*a*, 64*b* are in contact with either the outer handle 60 or the carriage 50. In this manner, the inner handles 62*a*, 62*b*, 64*a*, 64*b* appear to "float" when viewed from the top such as shown in FIG. 8A.

The shape, size, positioning, and number of inner handles 62*a*, 62*b*, 64*a*, 64*b* may vary in different embodiments. In the exemplary embodiment shown in the figures, a first inner handle 62*a* is positioned between a first side 57 of the first end portion 53 of the carriage platform 51 and the outer handle 60, without being in contact with either the carriage platform 51 or the outer handle 60. A second inner handle 62*b* is also positioned between a second side of the first end portion 53 of the carriage platform 51 and the outer handle 60, without being in contact with either the carriage page 51 or the outer handle 60. Both of the first and second inner handles 62*a*, 62*b* may extend at a right angle with respect to the track 30 as shown in the figures.

Continuing to reference FIG. 8A, a third inner handle 64*a* is positioned between a first side of the second end portion 54 of the carriage platform 51 and the outer handle 60, without being in contact with either the carriage platform 51 or the outer handle 60. A fourth inner handle 64*b* is also positioned between a second side of the second end portion 54 of the carriage platform 51 and the outer handle 60, without being in contact with either the carriage platform 51 or the outer handle 60. Both of the third and fourth inner handles 64*a*, 64*b* may extend at a right angle with respect to the track 30 as shown in the figures.

The figures illustrate an exemplary embodiment in which each of the inner handles 62*a*, 62*b*, 64*a*, 64*b* extends horizontally between the carriage 50 (e.g., the carriage platform 51 of the carriage 50) and the outer handle 60. Such an orientation is perpendicular with respect to the direction of the track 30. In such an orientation, the inner handles 62*a*, 62*b*, 64*a*, 64*b* are each parallel with respect to the linkages 61*a*, 61*b*, 61*c*, 61*d* connected between the carriage platform 51 and the outer handle 60.

However, it should be appreciated that other orientations of the inner handles 62*a*, 62*b*, 64*a*, 64*b* may be utilized in different embodiments. For example, each of the inner handles 62*a*, 62*b*, 64*a*, 64*b* may extend diagonally, with, for example, the first end of each of the inner handles 62*a*, 62*b*, 64*a*, 64*b* being at a higher elevation than the second end of each of the inner handles 62*a*, 62*b*, 64*a*, 64*b*, or vice versa.

Figure 12A:
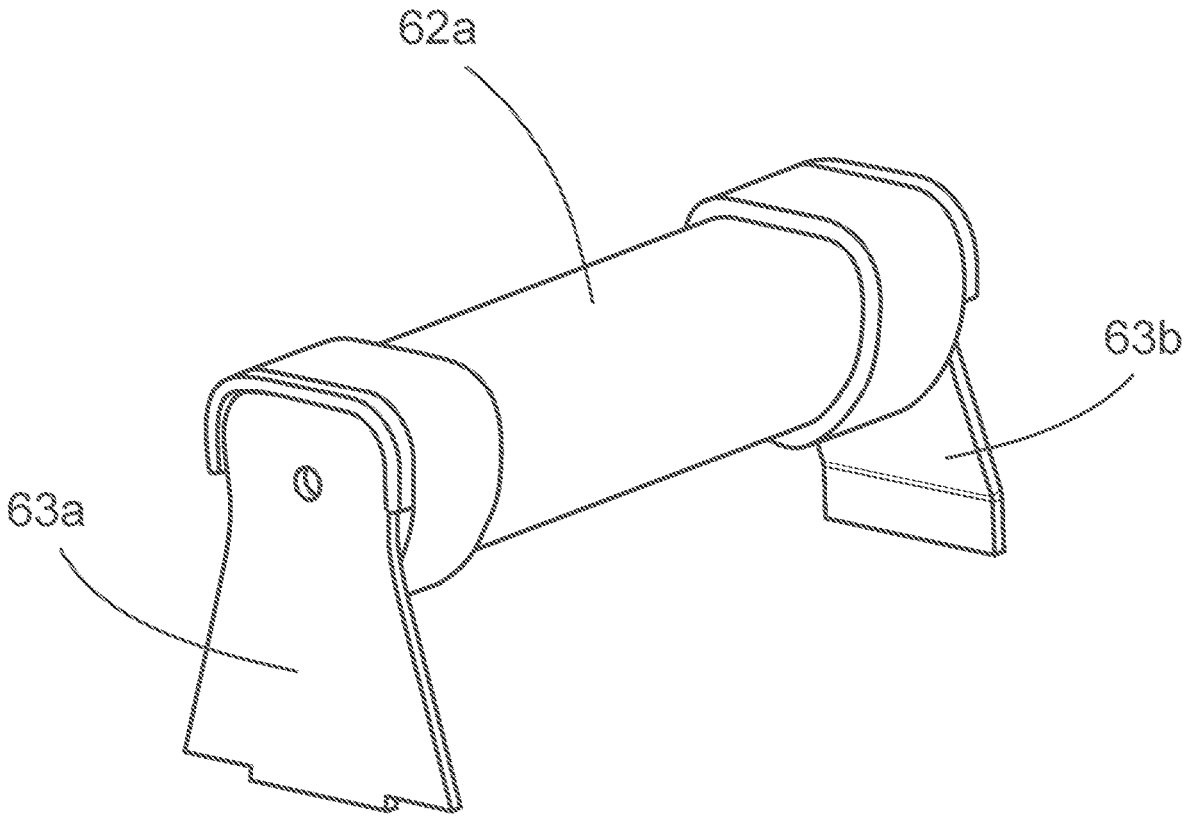
FIG. 12A is a perspective view of an exemplary inner handle of an exercise machine in accordance with an example embodiment.
Figure 12B:
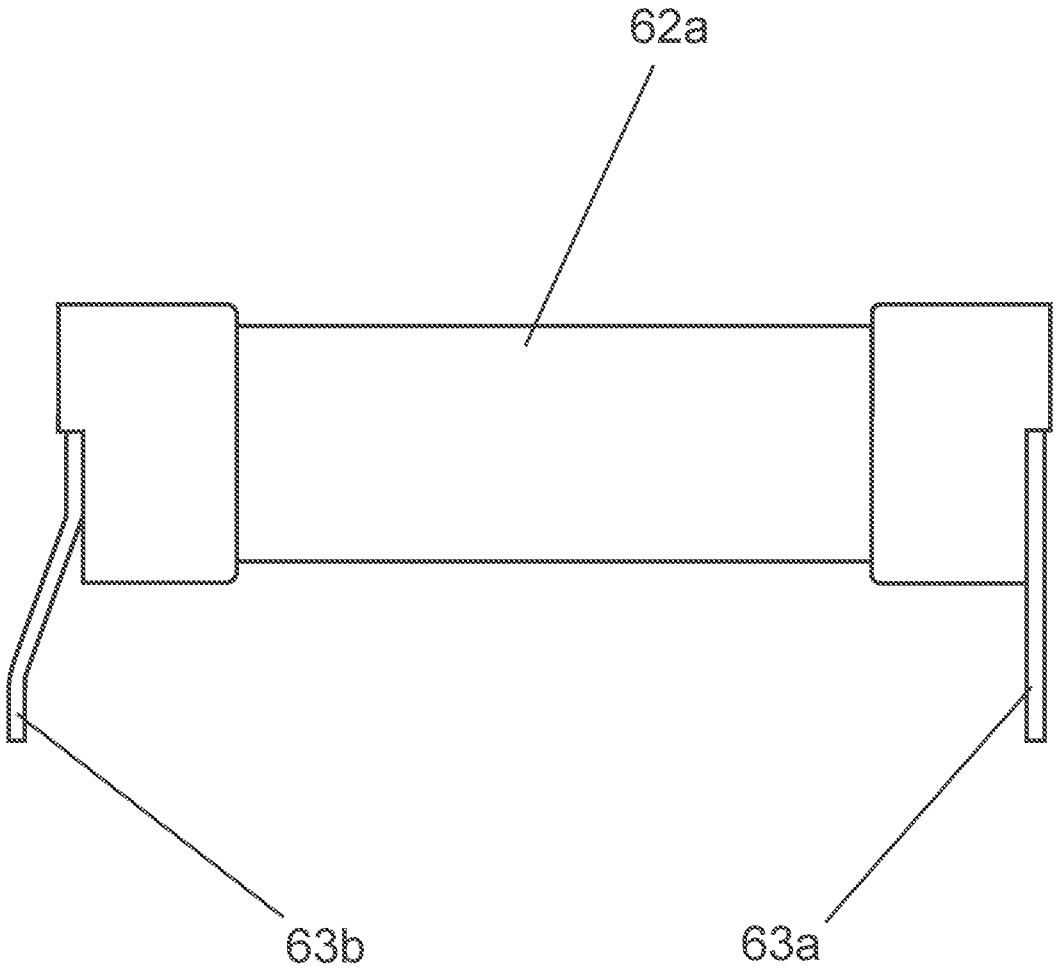
FIG. 12B is a frontal view of an exemplary inner handle of an exercise machine in accordance with an example embodiment.
Figure 13:
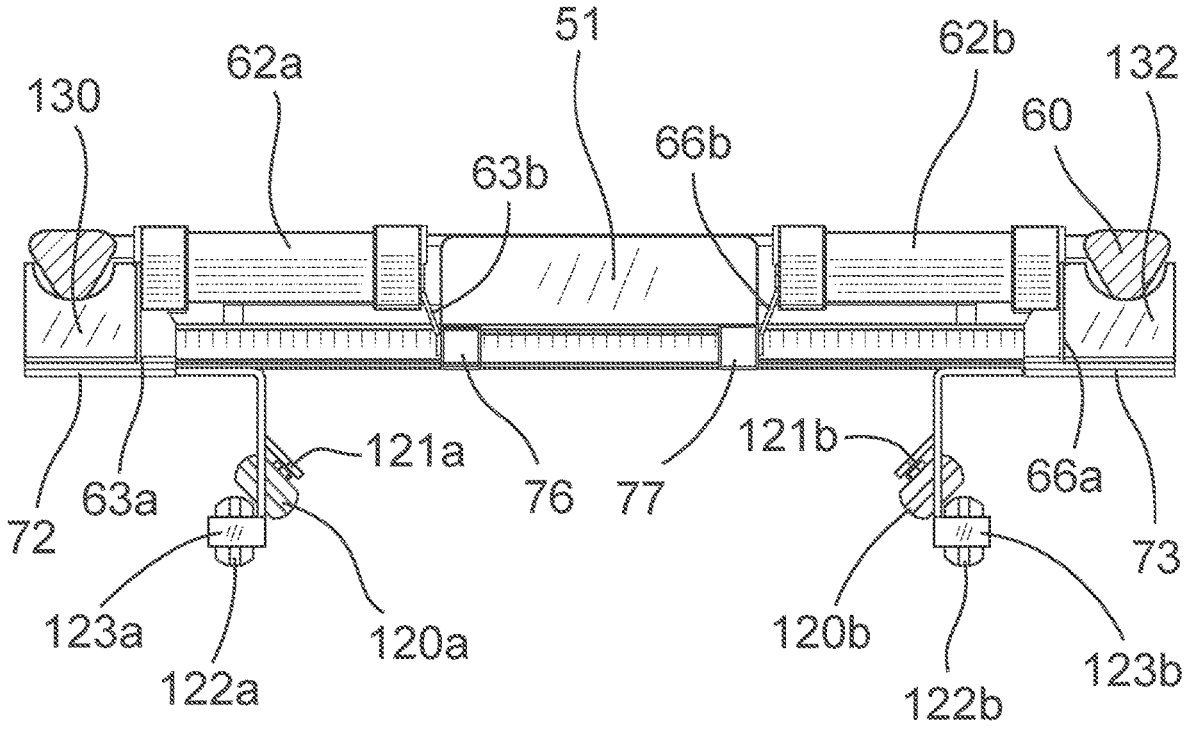
FIG. 13 is a sectional view of a carriage of an exercise machine taken along line 13-13 of FIG. 8A in accordance with an example embodiment.
Figure 14:
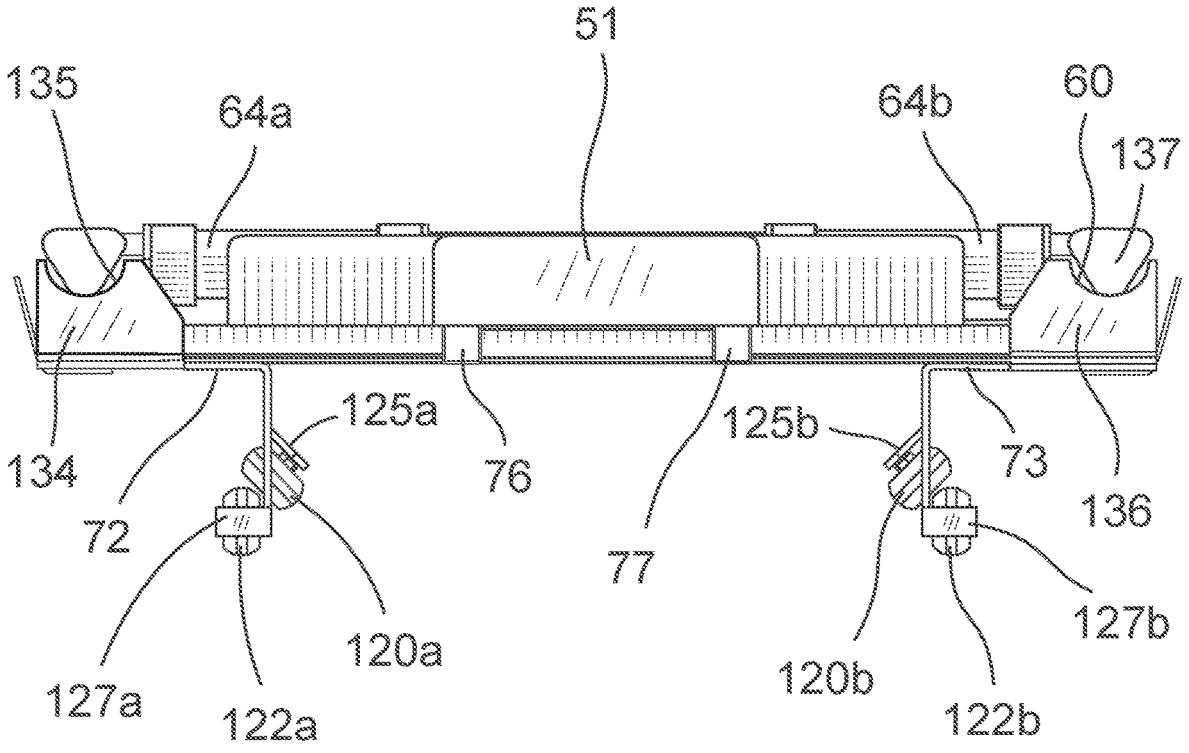
FIG. 14 is a sectional view of a carriage of an exercise machine taken along line 14-14 of FIG. 8A in accordance with an example embodiment.
Figure 15:
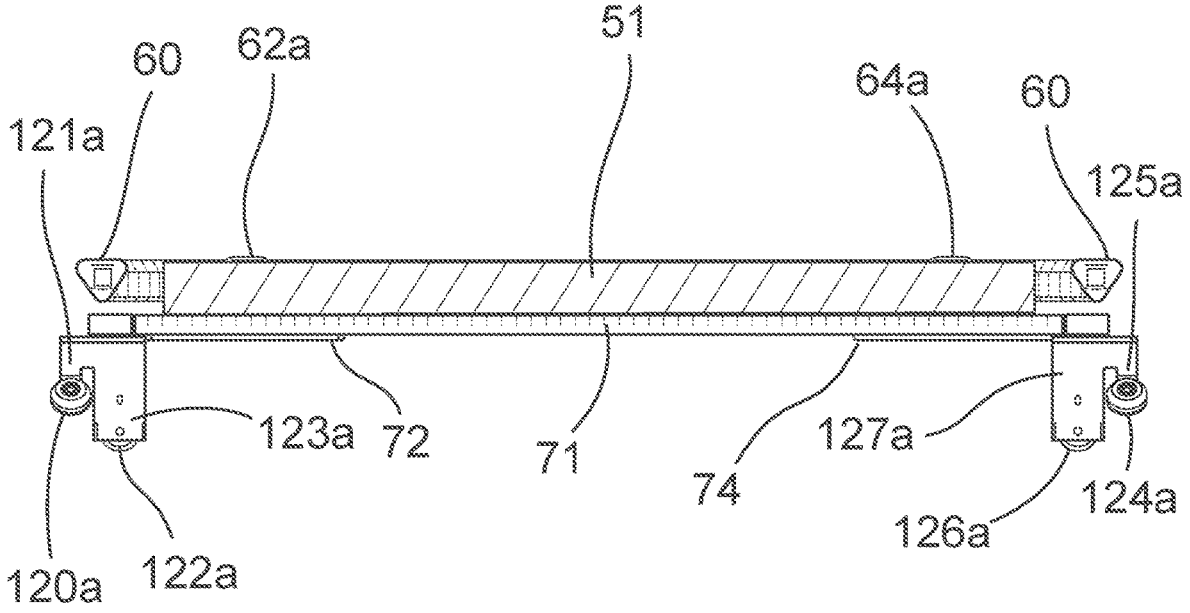
FIG. 15 is a sectional view of a carriage of an exercise machine taken along line 15-15 of FIG. 8A in accordance with an example embodiment.
Figure 16:
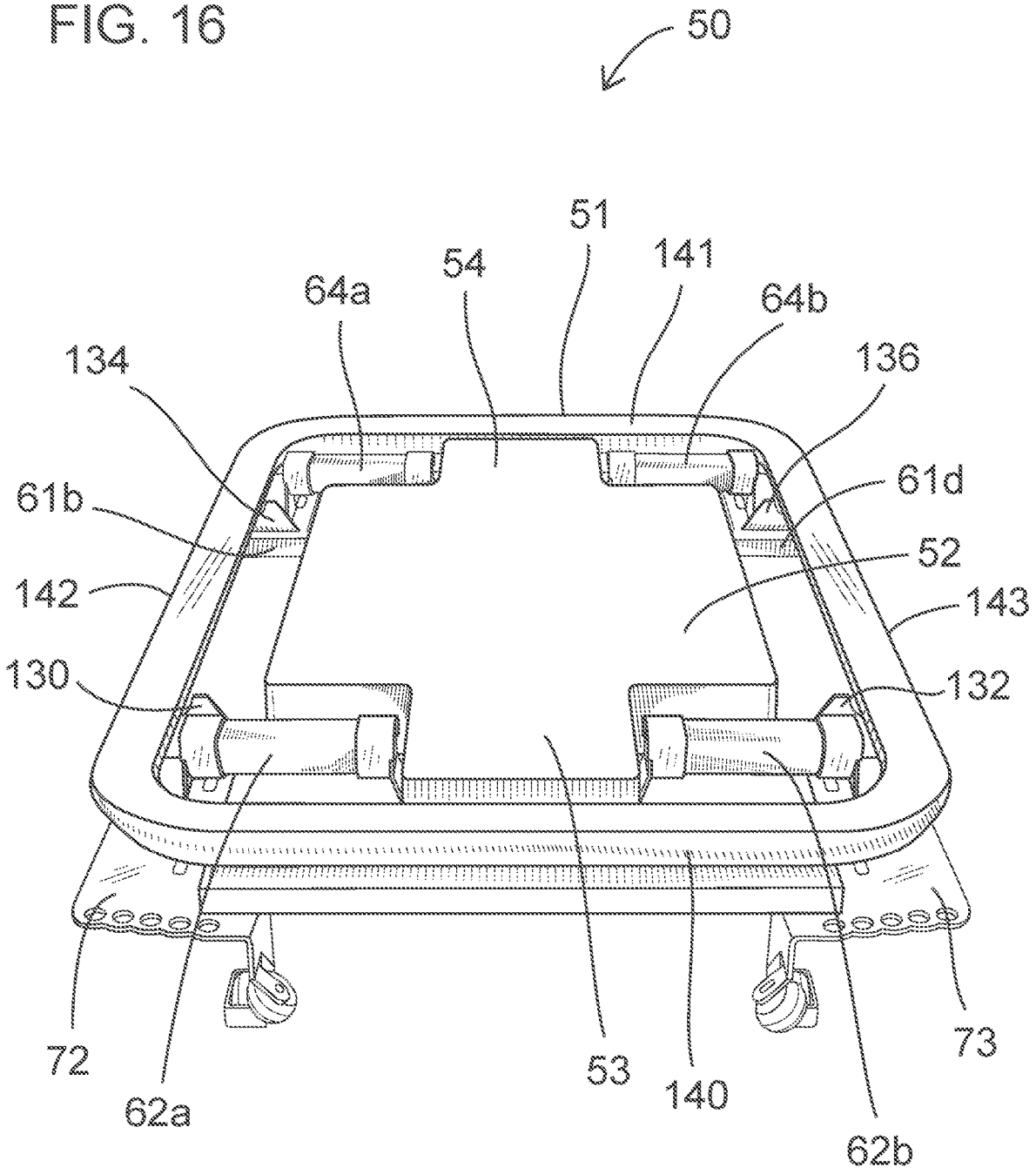
FIG. 16 is a perspective view of a carriage of an exercise machine in accordance with an example embodiment.
Figure 17:
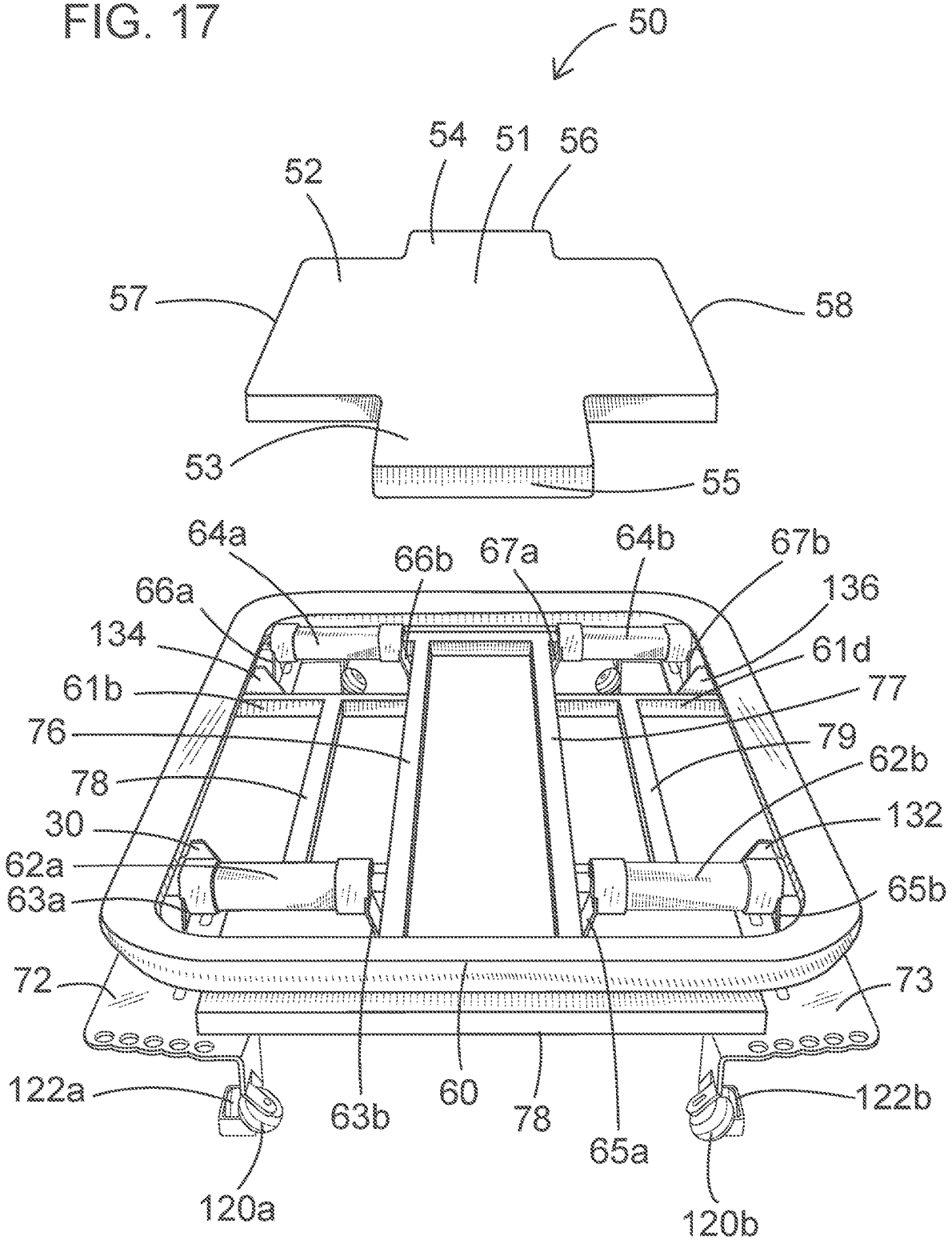
FIG. 17 is an exploded perspective view of a carriage with the carriage platform removed of an exercise machine in accordance with an example embodiment.

FIGS. 12A, 12B, 12C, and 12D illustrate exemplary embodiments of each of the inner handles 62*a*, 62*b*, 64*a*, 64*b*. FIG. 12A illustrates a first inner handle 62*a*, FIG. 12B illustrates a second inner handle 62*b*, FIG. 12C illustrates a third inner handle 64*a*, and FIG. 12D illustrates a fourth inner handle 64*b*.

As shown in FIGS. 12A, 12B, 12C, and 12D, each of the inner handles 62*a*, 62*b*, 64*a*, 64*b* comprising a gripping surface adapted to gripped by an exerciser during performance of various exercise moves. The shape of such gripping surfaces may vary in different embodiments, and may comprise, by way of example and without limitation, circular cross-sections, triangular cross-sections, square cross-sections, or polygonal cross-sections. Each of the inner handles 62*a*, 62*b*, 64*a*, 64*b* may comprise bands at or near their respective outer ends which serve to prevent the hand or feet of an exerciser from sliding or slipping off the outer ends of each of the inner handles 62*a*, 62*b*, 64*a*, 64*b*.

Continuing to reference FIGS. 12A, 12B, 12C, and 12D, it can be seen that each of the inner handles 62*a*, 62*b*, 64*a*, 64*b* comprises a pair of handle connectors 63*a*, 63*b*, 65*a*, 65*b*, 66*a*, 66*b*, 67*a*, 67*b*. The handle connectors 63*a*, 63*b*, 65*a*, 65*b*, 66*a*, 66*b*, 67*a*, 67*b* may comprise plates, brackets, clamps, or the like which are utilized to secure the inner handles 62*a*, 62*b*, 64*a*, 64*b* not to the outer handle 60 or to the carriage 50, but instead to a support assembly 70 underlying the carriage 50.

The handle connectors 63*a*, 63*b*, 65*a*, 65*b*, 66*a*, 66*b*, 67*a*, 67*b* are preferably shaped and sized so as to connect the inner handles 62*a*, 62*b*, 64*a*, 64*b* to the support frame 71 such that the inner handles 62*a*, 62*b*, 64*a*, 64*b* are neither connected to nor in contact with the carriage platform 51 or the outer handle 60 as shown in the figures. By connecting the inner handles 62*a*, 62*b*, 64*a*, 64*b* to the underlying support assembly 70, rather than to the outer handle 60 or the carriage 50, the inner handles 62*a*, 62*b*, 64*a*, 64*b* may have the appearance of "floating" carriage handles, especially when viewing the carriage 50 from the top such as shown in FIG. 8.

In the embodiment shown in the figures, the first connector 63*a*, 65*a*, 66*a*, 67*a* of each inner handle 62*a*, 62*b*, 64*a*, 64*b* is comprised of a vertically-oriented bracket structure adapted to connect to the support frame 71 or, more specifically, to the front and rear supports 72, 73, 74, 75 of the support frame 71. In contrast, the second connector 63*b*, 65*b*, 66*b*, 67*b* of each inner handle 62*a*, 62*b*, 64*a*, 64*b* is comprised of a slanted, or diagonal orientation.

The use of a slated or diagonal orientation of the second connector 63*b*, 65*b*, 66*b*, 67*b* of each inner handle 62*a*, 62*b*, 64*a*, 64*b* allows the second connectors 63*b*, 65*b*, 66*b*, 67*b* to connect to the support frame 71 underneath the carriage platform 51 while still allowing a gap or space between each inner handle 62*a*, 62*b*, 64*a*, 64*b* and the carriage platform 51 as shown in the figures. This type of configuration also prevents the need for portions of the support frame 71 (e.g., the cross supports 76, 77) from extending outwardly from the sides of the lower end of the carriage platform 51.

With reference to FIG. 12A, it can be seen that the first inner handle 62*a* comprises a first handle connector 63*a* and a second handle connector 63*b*. With reference to FIG. 12B, it can be seen that the second inner handle 62*b* comprises a first handle connector 65*a* and a second handle connector 65*b*. With reference to FIG. 12C, it can be seen that the third inner handle 64*a* comprises a first handle connector 66*a* and a second handle connector 66*b*. With reference to FIG. 12D, it can be seen that the fourth inner handle 64*b* comprises a first handle connector 67*a* and a second handle connector 67*b*.

As discussed in more detail below, the handle connectors 63*a*, 63*b*, 65*a*, 65*b*, 66*a*, 66*b*, 67*a*, 67*b* are utilized to connect the inner handles 62*a*, 62*b*, 64*a*, 64*b* to a support assembly 70 underlying the carriage 50. In this manner, the inner handles 62*a*, 62*b*, 64*a*, 64*b* may be disconnected from, and thus not in contact with, either the outer handle 60 or any portion of the carriage platform 51.

As shown in the figures, there is a gap or space between the outer ends of the respective inner handles 62*a*, 62*b*, 64*a*, 64*b* and the inner end of the outer handle 60. Similarly, there is a gap or space between the inner ends of the respective inner handles 62*a*, 62*b*, 64*a*, 64*b* and the outer end of the carriage platform 51, thus producing the "floating" effect discussed herein, particularly when viewing the carriage 50 from the top.

F. Support Assembly.

Each of the inner handles 62*a*, 62*b*, 64*a*, 64*b* is supported not by being connected to either the carriage platform 51 or the outer handle 60, but instead by a support assembly 70 connected to the lower end of the carriage 50. The support assembly 70 is best shown in FIG. 8B which illustrates the support assembly 70 with the carriage 50 removed and FIG. 10 which illustrates the underside of the carriage 50 to which the support assembly 70 is connected.

As shown, the support assembly 70 may comprise a support frame 71 of structural supports 61*a*, 61*b*, 61*c*, 61*d*, 72, 73, 74, 75, 76, 77 to which the carriage 50 may be connected and by which the carriage platform 51 may be supported, with the underside of the carriage platform 51 being secured to and supported by the support frame 71. In some embodiments, the carriage 50 may include the support assembly 70 (e.g., the carriage 50 and support assembly 70 may be integrally formed). In other embodiments, the support assembly 70 may be connected to the carriage 50.

As best shown in FIG. 10, the support frame 71 may comprise a first front support 72 and a second front support 73. The first front support 72 and the second front support 73 may each comprise a plate-like member which is connected to the outer handle 60 as discussed previously. The first front support 72 may be positioned at a first front corner of the outer handle 60 and the second front support 73 may be positioned at a second front corner of the outer handle 60 such as shown in the figures. The first and second front supports 72, 73 may include finger-holes as shown in the figures.

Continuing to reference FIG. 10, the first rear support 74 and the second rear support 75 may each comprise a plate-like member which is connected to the underside of the outer handle 60. The first rear support 74 may be positioned at a first front corner of the outer handle 60 and the second rear support 75 may be positioned at a second front corner of the outer handle 60 such as shown in the figures. The first and second rear supports 74, 75 may similarly include finger-holes such as shown in the figures.

As shown in FIG. 10, the support frame 71 may include a first end support 68*a* which is connected to and extends between the first front support 72 and the second front support 73. On the other end of the support frame 71 it can be seen that a second end support 68*b* is connected to and extends between the first rear support 74 and the second rear support 75. The end supports 68*a*, 68*b* may comprise elongated members, such as rods, beams, bars, poles, shafts, or the like. The manner in which the end supports 68*a*, 68*b* are connected between the respective front and rear supports 72, 73, 74, 75 may vary in different embodiments, including the use of welding, adhesives, and fasteners. In some embodiments, the end supports 68*a*, 68*b* may be integral with the front and rear supports 72, 73, 74, 75.

With reference to FIG. 10, it can be seen that the support frame 71 of the support assembly 70 may include a pair of cross supports 76, 77 which each extend between end supports 68*a*, 68*b*. The cross supports 76, 77 may comprise elongated members, such as rods, beams, bars, poles, shafts, or the like, to which the inner handles 62*a*, 62*b*, 64*a*, 64*b* may be connected. A first cross support 76 may extend between the first and second end supports 68*a*, 68*b* and a second cross support 77 may extend between the first and second end supports 68*a*, 68*b*, with the first and second cross supports 76, 77 being distally-spaced and parallel as shown in FIG. 10.

The spacing, positioning, and orientation of the pair of cross supports 76, 77 may vary in different embodiments. In the exemplary embodiment best shown in FIGS. 8B and 10, it can be seen that the distance (spacing) between the cross supports 76, 77 is substantially equal to the width of the end portions 53, 54 of the carriage platform 51. In this manner, the first cross support 76 may be flush with the first outer edge of the end portions 53, 54 and the second cross support 77 may be flush with the second outer edge of the end portions 53, 54. Such a configuration prevents the cross supports 76, 77 from jutting out from the edges of the end portions 53, 54 of the carriage platform 51.

With reference to FIG. 10, it can be seen that a first cross support 76 extends between the first and second ends 55, 56 of the carriage 50 and a second cross support 77 extends between the first and second ends 55, 56 of the carriage 50, with the first cross support 76 being spaced-apart from and parallel with respect to the second cross support 77. The distance or spacing between the parallel cross supports 76, 77 may vary in different embodiments, with the exemplary embodiment of the figures showing an embodiment in which such a distance is equal to the width of the end portions 53, 54 of the carriage platform 51.

With reference to FIGS. 8B and 10, it can be seen that the support frame 71 may include linkages 61*a*, 61*b*, 61*c*, 61*d*. In the embodiment shown, the first linkage 61*a* is connected between the first front support 72 and the first cross support 76. The second linkage 61*b* is connected between the first rear support 74 and the first cross support 76, with the second linkage 61*b* being both distally-spaced and parallel with respect to the first linkage 61*a*. In the figures, it can be seen that the first linkage 61*a* is parallel with the first inner handle 63*a* and the second linkage 61*b* is parallel with the third inner handle 64*a*.

Continuing to reference FIGS. 8B and 10, it can be seen that the third linkage 61*c* is connected between the second front support 73 and the second cross support 77. The fourth linkage 61*d* is connected between the second rear support 75 and the second cross support 77, with the fourth linkage 61*d* being both distally-spaced and parallel with respect to the third linkage 61*c*. In the figures, it can be seen that the third linkage 61*c* is parallel with the second inner handle 63*b* and the fourth linkage 61*d* is parallel with the fourth inner handle 64*b*.

The support frame 71 may comprise braces 78, 79 which provide structural integrity to the support frame 71 such as shown in FIGS. 8B and 10. As shown, a first brace 78 may extend between and be connected between the first and second linkages 61*a*, 61*b*, with the first brace 78 being perpendicular to both of the first and second linkages 61*a*, 61*b*. Similarly, a second brace 79 may extend between and be connected between the third and fourth linkages 61*c*, 61*d*, with the second brace 79 being perpendicular to both of the third and fourth linkages 61*c*, 61*d*. The braces 78, 79 may comprise various elongated members, such as rods, beams, bars, poles, shafts, or the like.

The carriage 50, including the carriage platform 51, may be secured upon and connected to the support frame 71 such as shown in FIGS. 8A and 10. The first brace 78 and the second brace 79 may each be connected to the underside of the central portion 53 of the carriage 50. The linkages 61*a*, 61*b*, 61*c*, 61*d* may be connected to the underside of the central portion 53 of the carriage 50 and to the front and rear supports 72, 73, 74, 75. The cross supports 76, 77 may be connected to and support the length of the carriage 70 between its first and second ends 55, 56, including both end portions 53, 54 and the central portion 52 of the carriage 70 as shown in FIG. 10.

The support frame 71 of the support assembly 70 provides an anchoring or connection point for each of the inner handles 62*a*, 62*b*, 64*a*, 64*b* such that none of the inner handles 62*a*, 62*b*, 64*a*, 64*b* need be connected directly to the carriage platform 51 or the outer handle 60 so as to utilize a "floating" configuration as shown in the figures. In such a configuration, there is a gap or space between each of the inner handles 62*a*, 62*b*, 64*a*, 64*b* and the outer handle 60 and carriage platform 51.

As best shown in FIGS. 8 and 10, each of the inner handles 62*a*, 62*b*, 64*a*, 64*b* is connected between a front or rear support 72, 73, 74, 75 and a cross support 76, 77. In an exemplary embodiment, the first inner handle 62*a* includes a first handle connector 63*a* and a second handle connector 63*b*, with the first handle connector 63*a* being connected to the first front support 72 and the second handle connector 63*b* being connected to the first cross support 76. The second inner handle 62*b* includes a first handle connector 65*a* and a second handle connector 65*b*, with the first handle connector 65*a* being connected to the second front support 73 and the second handle connector 65*b* being connected to the second cross support 77.

Continuing to reference FIGS. 8 and 10, it can be seen that the third inner handle 64*a* includes a first handle connector 66*a* and a second handle connector 66*b*, with the first handle connector 66*a* being connected to the first rear support 74 and the second handle connector 66*b* being connected to the first cross support 76. The fourth inner handle 64*b* includes a first handle connector 67*a* and a second handle connector 67*b*, with the first handle connector 67*a* being connected to the second rear support 75 and the second handle connector 67*b* being connected to the second cross support 77.

As shown in the figures, each of the inner handles 62*a*, 62*b*, 64*a*, 64*b* are not in contact with or connected to either the carriage 50 (including the carriage platform 51) or the outer handle 60. Thus, there is a gap or space between the first handle connector 63*a* of the first inner handle 62*a* and the outer handle 60 and a gap or space between the second handle connector 63*b* of the first inner handle 62*a* and the first end portion 53 of the carriage platform 51. Similarly, there is a gap or space between the first handle connector 65*a* of the second inner handle 62*a* and the outer handle 60 and a gap or space between the second handle connector 65*b* of the second inner handle 62*b* and the first end portion 53 of the carriage platform 51.

With respect to the third inner handle 64*a*, there is a gap or space between the first handle connector 66*a* of the third inner handle 64*a* and the outer handle 60 and a gap or space between the second handle connector 66*b* of the third inner handle 64*a* and the second end portion 54 of the carriage platform 51. Similarly, there is a gap or space between the first handle connector 67*a* of the fourth inner handle 64*b* and the outer handle 60 and a gap or space between the second handle connector 67*b* and the second end portion 54 of the carriage platform 51. These gaps or spaces create the "floating" configuration of the inner handles 62*a*, 62*b*, 64*a*, 64*b* as best seen from above the carriage 50.

The manner in which the handle connectors 63*a*, 63*b*, 65*a*, 65*b*, 66*a*, 66*b*, 67*a*, 67*b* are connected to the respective supports 72, 73, 74, 75, 76, 77 may vary in different embodiments. In some embodiments, the handle connectors may be welded to their respective supports 72, 73, 74, 75, 76, 77. In other embodiments, clamps, fasteners, adhesives, or the like may be utilized to effectuate the connections between the handle connectors 63*a*, 63*b*, 65*a*, 65*b*, 66*a*, 66*b*, 67*a*, 67*b* and the respective supports 72, 73, 74, 75, 76, 77 to which they are connected.

G. End Handles.

As best shown in FIGS. 1-7B, the exercise machine 10 may include a pair of end handles 100, 105, with a first end handle 100 extending outwardly from a first end 21 of the frame 20 and a second end handle 105 extending outwardly from a second end 22 of the frame 20. The respective end handles 100, 105 may be provided to allow for a wider range of exercise moves to be performed by the exerciser than would be possible without the use of such end handles 100, 105. For example, an exerciser could stand adjacent to the front or rear ends 51, 52 of the frame 50, but off the exercise machine 10, to utilize the end handles 100, 105 for exercise moves. Alternatively, the exerciser could utilize the first end handle 100 to perform exercise moves while positioned on the first end platform 80 and the second end handle 105 to perform exercise moves while positioned on the second end platform 85. Additionally, the end handles 100, 105 may be utilized as steps for an exerciser to step onto or off of the end platforms 80, 85.

Figure 7A:
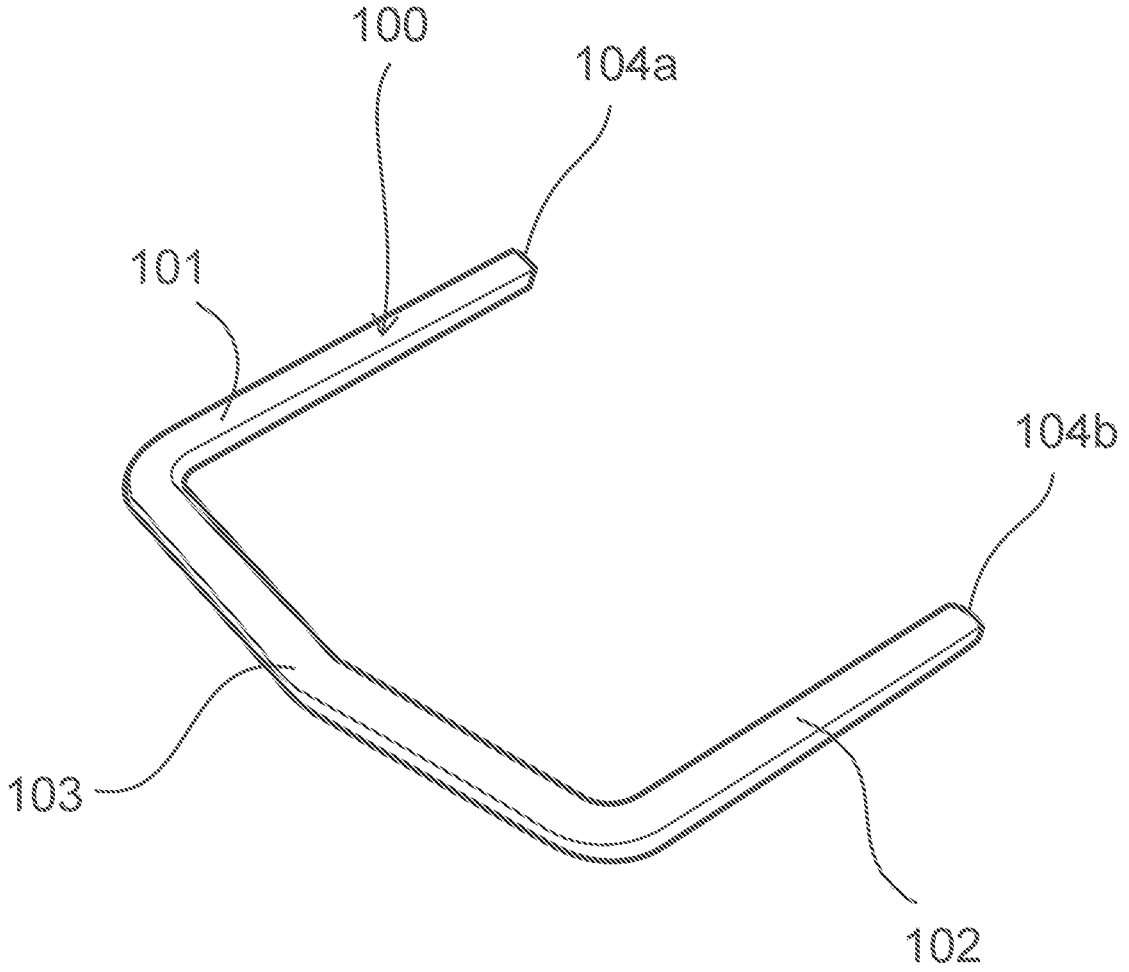
FIG. 7A is a perspective view of an exemplary first end handle for use with an exercise machine in accordance with an example embodiment.

FIG. 7A illustrates an exemplary embodiment of a first end handle 100 which may extend from the first end 51 of the frame 50 of an exercise machine 10. It should be appreciated that the shape, size, and structure of the first end handle 100 may vary in different embodiments, and thus should not be construed as limited by the exemplary embodiment shown in the figures. In the exemplary embodiment shown in the figures, the cross member 103 of the first end handle 100 extends angularly to converge at a point at its mid-point such as shown in FIG. 7A. In other embodiments, the cross member 103 may be perpendicular with respect to the parallel arms 101, 102.

As shown in FIG. 7A, the first end handle 100 may comprise a first arm 101, a second arm 102, and a cross member 103 extending between the distal ends of the first and second arms 101, 102 to form a substantially U-shaped configuration. The first arm 101 may comprise an elongated member having various cross-sections that includes a distal end 104*a* that may be connected to the exercise machine 10, such as to the frame 50. Similarly, the second arm 102 may include a distal end 104*b* that may be connected to the exercise machine 10, such as to the frame 50.

The manner in which the first end handle 100 is connected to the exercise machine 10 may vary in different embodiments, including but not limited to the use of fasteners, welding, adhesives, clamps, brackets, and the like. In the exemplary embodiment shown in the figures, the first end handle 100 is connected to the first outer support 40 of the exercise machine 10.

The positioning of the first end handle 100 may vary in different embodiments. In the exemplary embodiment best shown in FIG. 3, it can be seen that the first end handle 100 extends outwardly from the first end 21 of the frame 20 of the exercise machine 10, with the first end handle 100 extending outwardly past the first end platform 80. The first end handle 100 is generally positioned beneath the first end platform 80 and the track 30 as shown in FIG. 3. The first end handle 100 may extend parallel to a longitudinal axis extending between the first and second ends 21, 22 of the frame 20 of the exercise machine 10.

FIG. 7A illustrates an exemplary embodiment of a first end handle 100 which may extend from the first end 51 of the frame 50 of an exercise machine 10. It should be appreciated that the shape, size, and structure of the first end handle 100 may vary in different embodiments, and thus should not be construed as limited by the exemplary embodiment shown in the figures. In the exemplary embodiment shown in the figures, the cross member 103 of the first end handle 100 extends angularly to converge at a point at its mid-point such as shown in FIG. 7A. In other embodiments, the cross member 103 may be perpendicular with respect to the parallel arms 101, 102.

Figure 7B:
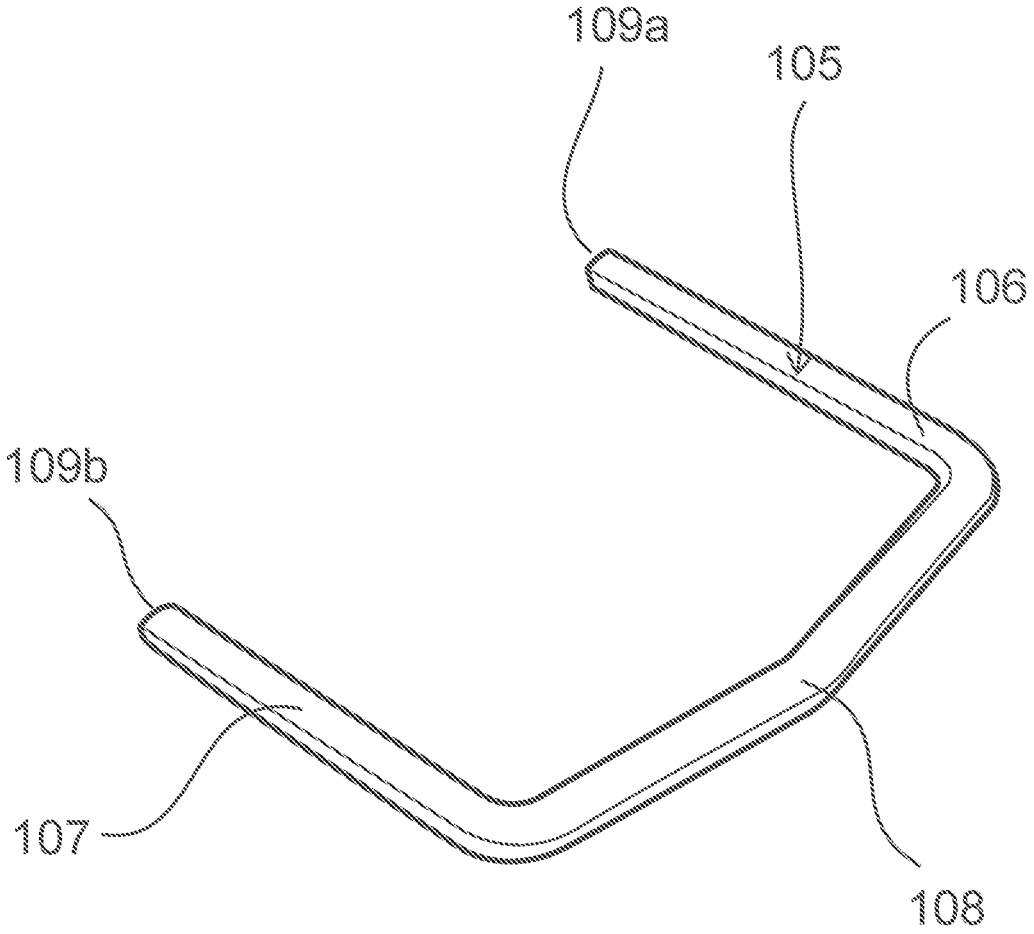
FIG. 7B is a perspective view of an exemplary second end handle for use with an exercise machine in accordance with an example embodiment.

As shown in FIG. 7B, the second end handle 105 may comprise a first arm 106, a second arm 107, and a cross member 108 extending between the distal ends of the first and second arms 106, 107 to form a substantially U-shaped configuration. The first arm 106 may comprise an elongated member having various cross-sections that includes a distal end 109*a* that may be connected to the exercise machine 10, such as to the frame 50. Similarly, the second arm 107 may include a distal end 109*b* that may be connected to the exercise machine 10, such as to the frame 50.

The manner in which the second end handle 105 is connected to the exercise machine 10 may vary in different embodiments, including but not limited to the use of fasteners, welding, adhesives, clamps, brackets, and the like. In the exemplary embodiment shown in the figures, the second end handle 105 is connected to the second outer support 44 of the exercise machine 10.

The positioning of the second end handle 105 may vary in different embodiments. In the exemplary embodiment best shown in FIG. 3, it can be seen that the second end handle 105 extends outwardly from the second end 22 of the frame 20 of the exercise machine 10, with the second end handle 105 extending outwardly past the second end platform 85. The second end handle 105 is generally positioned beneath the second end platform 85 and the track 30 as shown in FIG. 3. The second end handle 105 may extend parallel to a longitudinal axis extending between the first and second ends 21, 22 of the frame 20 of the exercise machine 10.

In embodiments in which the first end platform 80 includes a first end platform handle 84, the first end handle 100 may extend outwardly past the first end platform handle 84 and beneath the first end platform handle 84. Similarly, in embodiments in which the second end platform 85 includes a second end platform handle 89, the second end handle 105 may extend outwardly past the second end platform handle 89 and beneath the second end platform handle 89.

The first end handle 100 may be affixed to the first end 21 of the frame 20 of the exercise machine 10, such as to the first outer support 40 as shown in the figures, with the top plane of the first end handle 100 being substantially parallel to the horizontal plane of the first end platform 80, and positioned between the ground surface and the lower surface of the first platform handle 84.

The second end handle 105 may be affixed to the second end 22 of the frame 20 of the exercise machine 10, such as to the second outer support 44 as shown in the figures, with the top plane of the second end handle 105 being substantially parallel to the horizontal plane of the second end platform 85, and positioned between the ground surface and the lower surface of the second platform handle 89.

H. Operation of Preferred Embodiment.

The various embodiments of an exercise machine 10 described and shown herein may be utilized in a variety of manners by an exerciser to perform a wide range of exercise moves. The exercise machine 10 will generally be positioned on a ground surface, such as a floor, with the footings 41*a*, 41*b*, 45*a*, 45*b*, 48*a*, 48*b* contacting the ground surface. An exerciser may then place portions of his/her body, including but not limited to the torso, arm(s), leg(s), hand(s), feet, head, neck, etc. on various portions of the exercise machine 10. By way of example and without limitation, the exerciser could place his/her hands on an end platform 80, 85 and his/her feet on the carriage 50. The carriage 50 may be moved back and forth along at least a portion of the track 30, with any bias members 92 connected to the carriage 50 provided a resistance force against movement of the carriage 50 in a direction.

To select the resistance level, the exerciser 10 may select how many of the bias members 92 are connected to the carriage 50. Any desired bias members 92 may be retrieved from the bias member retainer 90 and then removably connected to the carriage bias receiver 94. When the carriage 50 is in its resting position, the carriage bias receiver 94 may be directly on top of the bias member retainer 90 to ease transfer of any desired bias members 92 from the bias member retainer 90 to the carriage bias receiver 94, or vice versa.

The exerciser may select how many bias members 92 to secure to the carriage 50 prior to moving the carriage 50. Generally, connecting more bias members 92 to the carriage 50 will increase the resistance of the carriage 50 to being moved in a certain direction, and connecting less bias members 92 to the carriage 50 will decrease the resistance of the carriage 50 to being moved in a certain direction. The positioning of the bias member retainer 90 at a central location along the frame 20, underneath the resting carriage 50, eases the transferring of bias members 92 from the carriage 50 to the bias member retainer 90 and vice versa. Preferably, the bias member retainer 90 is positioned directly underneath the resting position of the carriage 50 such as shown in the figures. The bias member retainer 90 includes an opening 91 at its front end out of which the bias members 92 extend.

The bias retainer 90 provides for preventing the bias members 92 from being exposed to an exerciser during an exercise, and further, in the event of the occasional failure of a bias member 92 under tension, prevents the violently retracting portion of the failed bias member 92 from striking the exerciser, and prevents damage to other components of the exercise machine 10.

The exerciser may use one or more of the inner handles 62*a*, 62*b*, 64*a*, 64*b* when performing a wide range of exercises. As discussed previously, the inner handles 62*a*, 62*b*, 64*a*, 64*b* are not connected to either the carriage 50 or the outer handle 60, but instead are connected to support structures of a support assembly 70 which is connected to the underside of the carriage 50. In this regard, the inner handles 62*a*, 62*b*, 64*a*, 64*b* appear to be "floating", particularly when viewing the carriage 50 from its upper end.

The inner handles 62*a*, 62*b*, 64*a*, 64*b* may be gripped by the exerciser when performing exercises, sometimes in combination with gripping the outer handle 60 and/or other gripping surfaces of the carriage 50. The inner handles 62*a*, 62*b*, 64*a*, 64*b* may be gripped by the hands of the exerciser, or the exerciser may position other body parts on the inner handles 62*a*, 62*b*, 64*a*, 64*b* to perform various exercises which involve moving the carriage 50 along the track 30 in various manners. By way of example and without limitation, the exerciser may place his/her feet on the inner handles 62*a*, 62*b*, 64*a*, 64*b* to aid in moving the carriage 50 along the track 30.

The end handles 100, 105 may also be utilized by the exerciser in performing various exercises with the exercise machine 10. For example, the exerciser may stand, kneel, sit, or otherwise position himself or herself adjacent to the exercise machine 10, but not on the exercise machine 10, and grip one of the end handles 100, 105 to perform various exercises. Alternatively, the exerciser may position himself or herself on one of the end platforms 80, 85 and grip the one of the end handles 100, 105 to perform various exercise movements. A wide range of exercise moves, either involving the carriage 50 or not, may benefit from the use of one or both of the end handles 100, 105 which extend outwardly from the respective ends 21, 22 of the frame 20 of the exercise machine 10. The end handles 100, 105 may also function as steps to aid the exerciser with stepping onto or off of the exercise machine 10.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine, suitable methods and materials are described above. All publications, patent applications, patents, and other references mentioned herein are incorporated by reference in their entirety to the extent allowed by applicable law and regulations. The exercise machine may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having a first end, a second end opposite of the first end, and a longitudinal axis extending therebetween, wherein the frame comprises a track including at least one rail;

a carriage movably positioned upon the track, wherein the carriage comprises a support frame and a carriage platform connected to the support frame, the carriage platform having a first end, a second end opposite the first end of the carriage, a first side, a second side opposite the first side of the carriage platform, an upper end, and a lower end opposite the upper end of the carriage platform, wherein the first end and the second end of the carriage platform are spaced apart along the longitudinal axis;

wherein the carriage is adapted to be movable in opposed first and second directions along at least a portion of the track;

a bias member connected between the carriage and the frame, wherein the bias member is adapted to provide a resistance force against movement of the carriage on the track; and an outer handle connected to the support frame, wherein the outer handle comprises a first end and a second end, wherein the outer handle extends around the carriage platform such that the outer handle surrounds the carriage platform, wherein the outer handle is not directly connected to the carriage platform.

2. The exercise machine of claim 1, wherein the outer handle is not in contact with the carriage platform.

3. The exercise machine of claim 1, wherein the support frame comprises a first front support including a first front bracket, wherein the outer handle is connected to the first front bracket of the first front support at or near the first end of the outer handle.

4. The exercise machine of claim 3, wherein the first front bracket comprises a first cutout, wherein the outer handle is connected within the first cutout of the first front bracket.

5. The exercise machine of claim 4, wherein the support frame comprises a first rear support including a first rear bracket, wherein the outer handle is connected to the first rear bracket of the first rear support.

6. The exercise machine of claim 1, further comprising:

a first inner handle positioned between the first side of the carriage platform and the outer handle, wherein the first inner handle is connected to the support frame, wherein the first inner handle is not directly connected to the outer handle or the carriage platform; and a second inner handle positioned between the second side of the carriage platform and the outer handle, wherein the second inner handle is connected to the support frame, wherein the second inner handle is not directly connected to the outer handle or the carriage platform.

7. The exercise machine of claim 6, wherein the carriage platform comprises a central portion, a first end portion extending from a first end of the central portion, and a second end portion extending from a second end of the central portion, wherein the central portion of the carriage platform is wider than the first end portion and the second end portion of the carriage.

8. The exercise machine of claim 7, wherein the first inner handle and the second inner handle are each positioned between the first end portion of the carriage platform and the outer handle.

9. The exercise machine of claim 8, further comprising a third inner handle positioned between the first side of the carriage platform and the outer handle, wherein the third inner handle is connected to the support frame, wherein the third inner handle is not directly connected to the outer handle or the carriage platform.

10. The exercise machine of claim 9, wherein the third inner handle is positioned between the second end portion of the carriage platform and the outer handle.

11. The exercise machine of claim 10, further comprising a fourth inner handle positioned between the second side of the carriage platform and the outer handle, wherein the fourth inner handle is connected to the support frame, wherein the fourth inner handle is not directly connected to the outer handle or the carriage platform.

12. The exercise machine of claim 11, wherein the fourth inner handle is positioned between the second end portion of the carriage platform and the outer handle.

13. The exercise machine of claim 6, wherein the support frame comprises a first front support and a first cross support.

14. The exercise machine of claim 13, wherein the first inner handle is connected at a first end to the first front support and at a second end to the first cross support.

15. The exercise machine of claim 14, wherein the support frame further comprises a second front support and a second cross support.

16. The exercise machine of claim 15, wherein the second inner handle is connected at a first end to the second front support and at a second end to the second cross support.

17. The exercise machine of claim 6, further comprising an end platform connected at or near the first end or the second end of the frame.

* * * * *